US011676538B2

(12) United States Patent
Hashimoto et al.

(10) Patent No.: US 11,676,538 B2
(45) Date of Patent: Jun. 13, 2023

(54) ELECTRONIC DEVICE

(71) Applicant: Innolux Corporation, Miao-Li County (TW)

(72) Inventors: Kazuyuki Hashimoto, Miao-Li County (TW); Hidetoshi Watanabe, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/862,410

(22) Filed: Jul. 12, 2022

(65) Prior Publication Data

US 2023/0120265 A1 Apr. 20, 2023

Related U.S. Application Data

(60) Provisional application No. 63/255,961, filed on Oct. 15, 2021.

(51) Int. Cl.
*G09G 3/3233* (2016.01)

(52) U.S. Cl.
CPC ... *G09G 3/3233* (2013.01); *G09G 2300/0852* (2013.01); *G09G 2300/0861* (2013.01); *G09G 2310/066* (2013.01); *G09G 2310/08* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 8,599,111 | B2 * | 12/2013 | Abe | G09G 3/3283 345/76 |
| 9,626,909 | B2 * | 4/2017 | Ceballos | G09G 3/3258 |
| 10,002,565 | B2 * | 6/2018 | Kikuchi | G09G 3/3266 |
| 10,157,578 | B2 * | 12/2018 | Kikuchi | H03M 1/1014 |
| 2004/0207614 | A1 * | 10/2004 | Yamashita | G09G 3/3258 345/211 |
| 2005/0156828 | A1 * | 7/2005 | Yamashita | G09G 3/3258 345/76 |
| 2021/0166618 | A1 * | 6/2021 | Baumheinrich | G09G 3/2077 |
| 2023/0027951 | A1 * | 1/2023 | Watsuda | G09G 3/3233 |

OTHER PUBLICATIONS

Kazuyuki Hashimoto et al., "Display Device", Unpublished U.S. Appl. No. 17/540,250, filed Dec. 2, 2021.

* cited by examiner

*Primary Examiner* — Matthew Yeung
(74) *Attorney, Agent, or Firm* — JCIPRNET

(57) ABSTRACT

An electronic device includes a light emitting unit, a current source, voltage comparator, and an emission control unit. The voltage comparator is configured to receive a voltage data and a ramp signal and output a comparison signal according to the voltage data and the ramp signal. The emission control unit is configured to output a driving current to the light emitting unit according to the supply current, the emission enable signal, and the comparison signal. The ramp signal is a first ramp signal during a first frame, and the ramp signal is a second ramp signal during a second frame after the first frame. The emission control unit is configured to be operated in a first mode based on the first ramp signal, and the emission control unit is configured to be operated in a second mode based on the second ramp signal.

19 Claims, 11 Drawing Sheets

ELECTRONIC DEVICE

CROSS-REFERENCE TO RELATED APPLICATION

This application claims the priority benefit of U.S. provisional application Ser. No. 63/255,961, filed on Oct. 15, 2021. The entirety of the above-mentioned patent application is hereby incorporated by reference herein and made a part of this specification.

BACKGROUND

Technical Field

The disclosure relates a device; particularly, the disclosure relates to an electronic device.

Description of Related Art

An electronic device may circuit implement pulse-width modulation (PWM) driving with control signals and programmed voltage data to define a pulse width. However, propagation delays and distortion of control signals of the electronic device may cause a time error (offset from target) of the pulse-width modulation, which can be seen as Mura in a display image.

SUMMARY

The electronic device of the disclosure includes a light emitting unit, a current source, a voltage comparator, and an emission control unit. The current source is configured to output a supply current. The voltage comparator is configured to receive a voltage data and a ramp signal and output a comparison signal according to the voltage data and the ramp signal. The emission control unit is coupled to the light emitting unit, the current source, and the voltage comparator. The emission control unit is configured to receive an emission enable signal and the comparison signal, and output a driving current to the light emitting unit according to the supply current, the emission enable signal, and the comparison signal. The ramp signal is a first ramp signal during a first frame, and the ramp signal is a second ramp signal different from the first ramp signal during a second frame after the first frame. The emission control unit is configured to be operated in a first mode based on the first ramp signal, and the emission control unit is configured to be operated in a second mode different from the first mode based on the second ramp signal.

The electronic device of the disclosure includes a pixel array. The pixel array includes a plurality of pixel units. The plurality of pixel units are divided into a plurality of first pixel units and a plurality of second pixel units. The plurality of the first pixel units and the plurality of the second pixel units are staggered. The plurality of pixel units are configured to respectively receive a plurality of emission enable signals, a plurality of voltage data, and a common ramp signal, and the plurality of pixel units are configured to be lighted up during a plurality of emission periods according to the plurality of emission enable signals, the plurality of voltage data, and the ramp signal respectively. Each of the plurality of first pixel units includes a first emission control unit, and each of the plurality of second pixel units includes a second emission control unit. The first emission control unit is configured to receive a first comparison signal and the second emission control common unit is configured to receive a second comparison signal, wherein the second comparison signal is inverted to the first comparison signal. The first emission control unit is configured to be operated in a first mode based on the common ramp signal, and the second emission control unit is configured to be operated in a second mode different from the first mode based on the common ramp signal.

Based on the above, according to the electronic device of the disclosure, the quality of the display images is improved.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
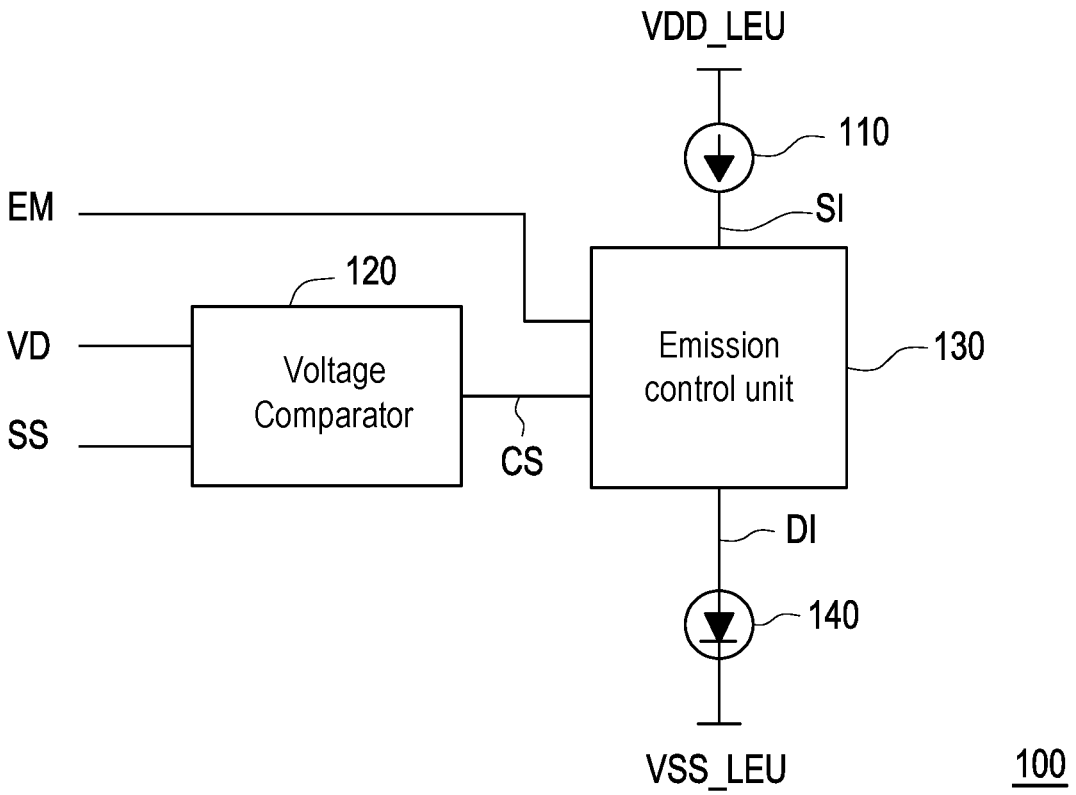
FIG. 1 is a schematic diagram of an electronic device according to an embodiment of the disclosure.

Reference will now be made in detail to the exemplary embodiments of the disclosure, examples of which are illustrated in the accompanying drawings. Whenever possible, the same reference numbers are used in the drawings and the description to refer to the same or like components.

Certain terms are used throughout the specification and appended claims of the disclosure to refer to specific components. Those skilled in the art should understand that electronic device manufacturers may refer to the same components by different names. This article does not intend to distinguish those components with the same function but different names. In the following description and rights request, the words such as "comprise" and "include" are open-ended terms, and should be explained as "including but not limited to . . . ".

The term "coupling (or connection)" used throughout the whole specification of the present application (including the appended claims) may refer to any direct or indirect connection means. For example, if the text describes that a first device is coupled (or connected) to a second device, it should be interpreted that the first device may be directly connected to the second device, or the first device may be indirectly connected through other devices or certain connection means to be connected to the second device. The terms "first", "second", and similar terms mentioned throughout the whole specification of the present application (including the appended claims) are merely used to name discrete elements or to differentiate among different embodiments or ranges. Therefore, the terms should not be regarded as limiting an upper limit or a lower limit of the quantity of the elements and should not be used to limit the arrangement sequence of elements. In addition, wherever possible, elements/components/steps using the same reference numerals in the drawings and the embodiments represent the same or similar parts. Reference may be mutually made to related descriptions of elements/components/steps using the same reference numerals or using the same terms in different embodiments.

The electronic device of the disclosure may include a display device, an antenna device, a sensing device, or a splicing device, but the disclosure is not limited to thereto. The electronic device of the disclosure may be a bendable or flexible electronic device. In some embodiment of the disclosure, the electronic device of the disclosure may, for example, be adapted to a liquid crystal, a light emitting diode, a quantum dot (QD), a fluorescence, a phosphor, other suitable display medium, or the combination of the aforementioned material, but the disclosure is not limited thereto. The light emitting diode may include, for example, organic light emitting diode (OLED), sub-millimeter light emitting diode (Mini LED), micro light emitting diode (Micro LED), or quantum dot light emitting diode (QLED or QDLED) or other suitable materials. The materials may be arranged and combined arbitrarily, but the disclosure is not limited to thereto. The antenna device may be a liquid crystal type antenna device or a non-liquid crystal type antenna device, but the disclosure is not limited to thereto. The splicing device may be, for example, a display splicing device or an antenna splicing device, but the disclosure is not limited to thereto. It should be noted that the electronic device may be any combination of the aforementioned, but the disclosure is not limited to thereto. Hereinafter, the display device as the electronic device or the splicing device will be used to illustrate the content of the disclosure, but the disclosure is not limited thereto.

It should be noted that in the following embodiments, the technical features of several different embodiments may be replaced, recombined, and mixed without departing from the spirit of the disclosure to complete other embodiments. As long as the features of each embodiment do not violate the spirit of the disclosure or conflict with each other, they may be mixed and used together arbitrarily.

FIG. 1 is a schematic diagram an electronic device according to an embodiment of the disclosure. Referring to FIG. 1, an electronic device 100 includes a pixel array, and the pixel array includes a plurality of pixel units. In one embodiment, the electronic device 100 may be a pixel unit, but the disclosure is not limited thereto. Each of the plurality of pixel units may include the circuit architecture as shown in FIG. 1. In the embodiment of the disclosure, the electronic device 100 includes a current source 110, a voltage comparator 120, an emission control unit 130 and a light emitting unit 140. The current source 110 is coupled between an operation voltage VDD_LEU and the emission control unit 130. The emission control unit 130 is further coupled to the voltage comparator 120 and the light emitting unit 140, and receives an emission enable signal EM. The light emitting unit 140 is coupled between the emission control unit 130 and a voltage VSS_LEU. The voltage VSS_LEU is lower than the operation voltage VDD_LEU. In the embodiment of the disclosure, the current source 110 is configured to output a supply current SI to the emission control unit 130. The voltage comparator 120 is configured to receive a voltage data VD and a ramp signal SS. The voltage comparator 120 outputs a comparison signal CS to the emission control unit 130 according to the voltage data VD and the ramp signal SS, and the emission control unit 130 outputs a driving current DI to the light emitting unit 140 according to the supply current SI, the emission enable signal EM, and the comparison signal CS. In the embodiment of the disclosure, the emission enable signal EM, the voltage data VD, and the ramp signal SS may be provided from multiple driving circuits respectively arranged out of an active area of the electronic device 100 or arranged inside the active area of the electronic device 100 through a data line and/or a scan line.

Figure 2:
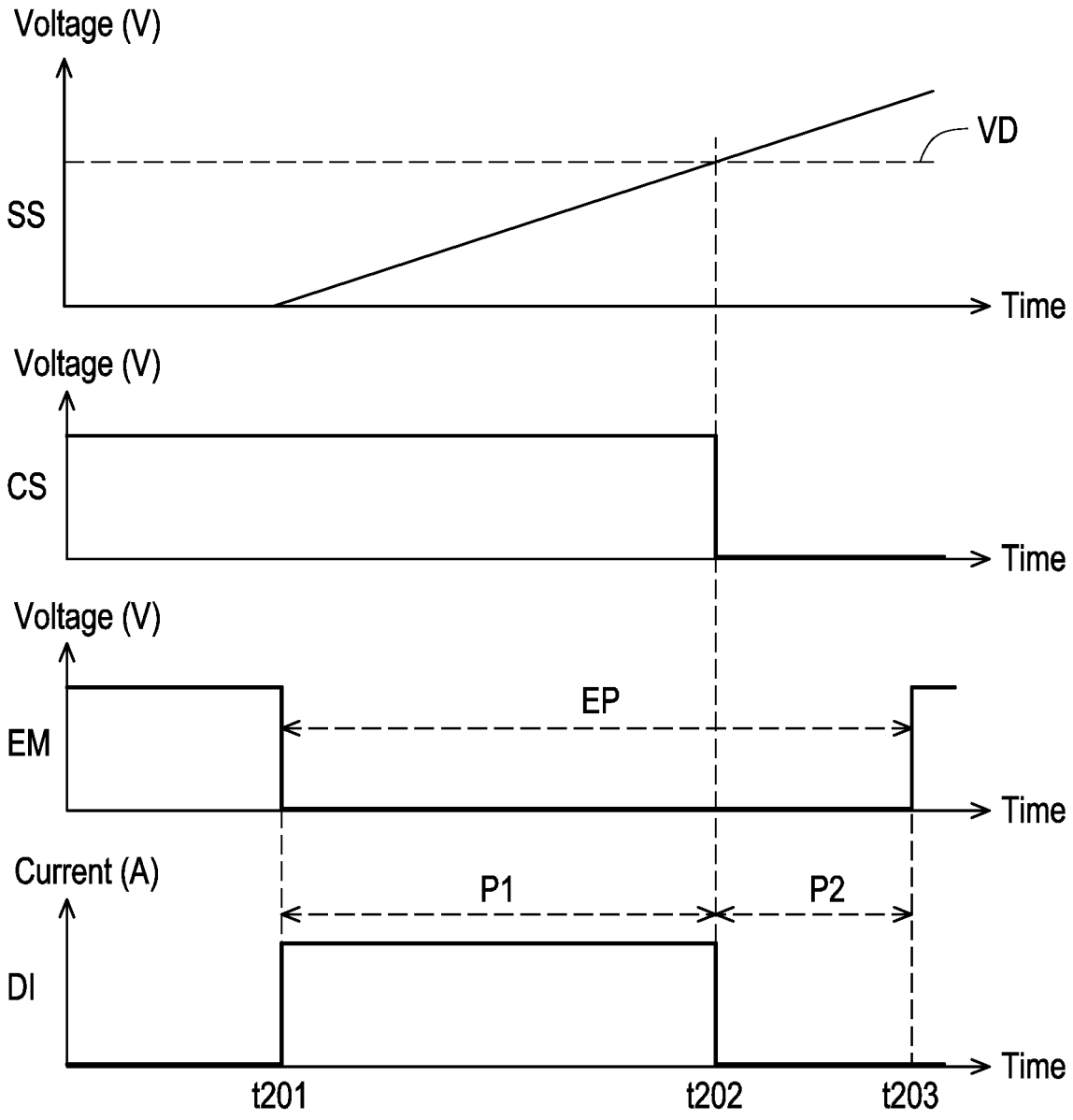
FIG. 2 is a schematic diagram of signals according to the embodiment of FIG. 1 of the disclosure.

FIG. 2 is a schematic diagram of signals according to the embodiment of FIG. 1 of the disclosure. Referring to FIG. 1 and FIG. 2, the voltage comparator 120 may receive the voltage data VD and the ramp signal SS. At time t201, the voltage of the ramp signal SS starts to rise to form a ramp waveform. Due to the voltage of the ramp signal SS is lower than the voltage of voltage data VD, the voltage comparator 120 outputs the comparison signal CS having a high voltage level. During an enable period EP from time t201 to time t203, the emission control unit 130 receives the emission enable signal EM having a low voltage level. After time t202, due to the voltage of the ramp signal SS is higher than the voltage of voltage data VD, the voltage comparator 120 outputs the comparison signal CS having the low voltage level. Thus, during a turn-on period (emission period/lighting period) P1 of the enable period EP from time t201 to time t202, the emission control unit 130 outputs the driving current DI to drive the light emitting unit 140. During a turn-off period P2 of the enable period EP from time t202 to time t203, the emission control unit 130 does not output the driving current DI to drive the light emitting unit 140.

In the embodiment of the disclosure, the voltage comparator 120 may further receive a pulse-width modulation (PWM) scan signal, and perform voltage programming on the voltage data VD according to the pulse-width modulation scan signal. The electronic device 100 may determine the turn-on period P1 by controlling the voltage level of the voltage data VD. If the voltage level of the voltage data VD is higher, the time length of the turn-on period P1 is longer. If the voltage level of the voltage data VD is lower, the time length of the turn-on period P1 is shorter. Further, if the emission enable signal EM changes to low voltage level earlier, the enable period EP starts earlier and thus the time length of the turn-on period P1 is longer. If the emission enable signal EM changes to low voltage level later, the enable period EP starts later, and thus the time length of the turn-on period P1 is shorter. That is, the time length of the turn-on period P1 of the driving current DI is determined by the emission enable signal EM, the voltage data VD and the ramp signal SS. In other word, the pixel units may be dimming by the voltage data VD to determine the time length of the turn light period of the pixel units. However, if there is a delay due to propagation delays and signal distortions of the emission enable signal EM and/or the ramp signal SS occur, the time length of the turn-on period P1 may be affected by the delay of the emission enable signal EM, and/or ramp signal SS, which can be seen as Mura in a display image.

In addition, in the embodiment of the disclosure, the ramp signal SS is a ramp-up signal, but the disclosure is not limited thereto. In one embodiment of the disclosure, the ramp signal SS may be a ramp-down signal. Moreover, in the embodiment of the disclosure, the emission enable signal EM is at the low voltage level from time t201 to time t203, and the driving current DI is generated from time t201 to time t202 based on the high voltage level of the comparison signal CS and the low voltage level of the emission enabled signal EM, but the disclosure is not limited thereto. In one embodiment of the disclosure, the emission enable signal EM is at the high voltage level from time t201 to time t203, and the driving current DI is generated from time t201 to time t202 based on the high voltage level of the comparison signal CS and the high voltage level of the emission enabled signal EM, but the disclosure is not limited thereto.

Figure 3:
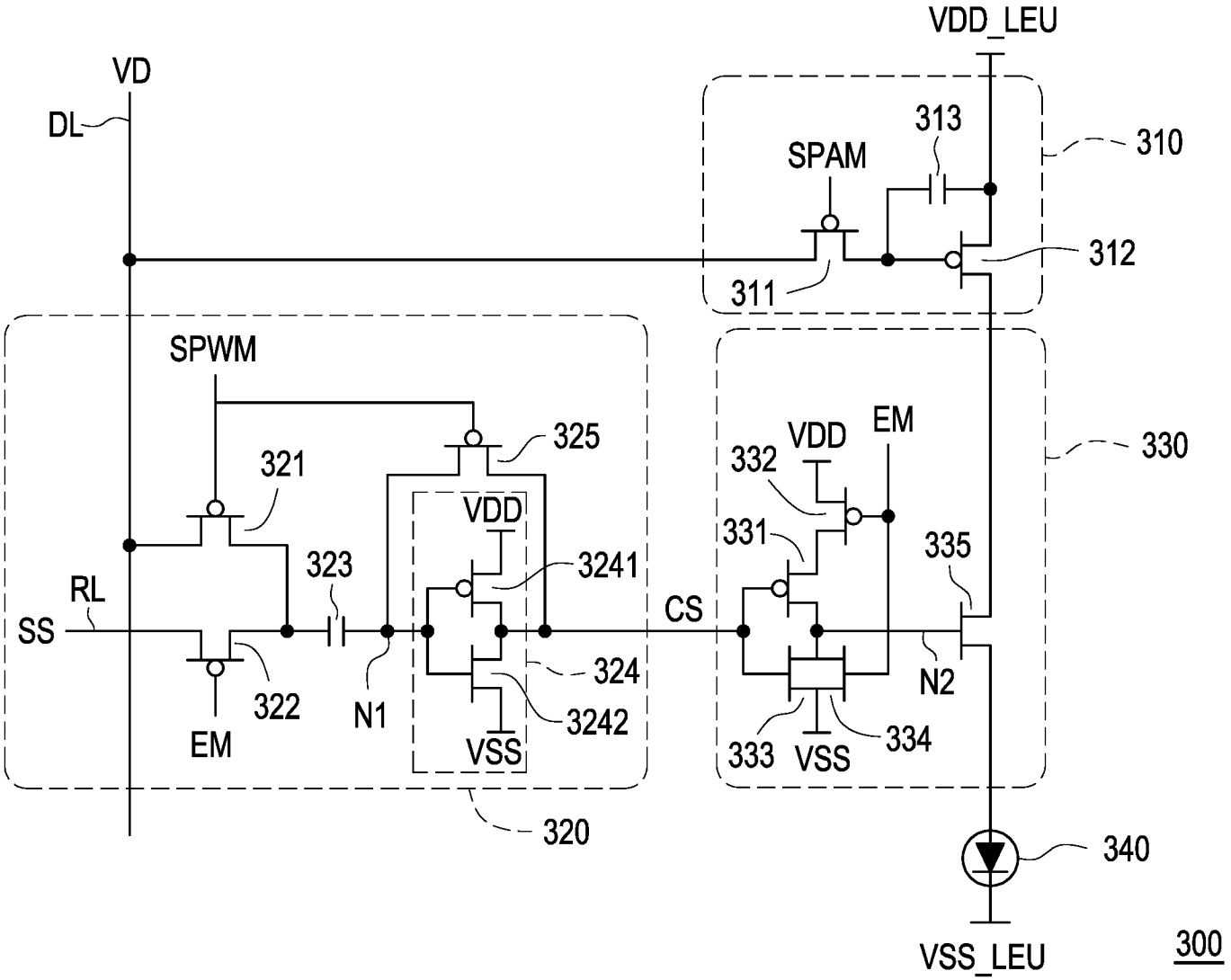
FIG. 3 is a schematic diagram of an electronic device according to an embodiment of the disclosure.

FIG. 3 is a schematic diagram of an electronic device according to an embodiment of the disclosure. Referring to FIG. 3, the electronic device 300 includes a pixel array, and the pixel array includes a plurality of pixel units. In one embodiment, the electronic device 300 may be a pixel unit, but the disclosure is not limited thereto. Each of the plurality of pixel units may include the circuit architecture as shown in FIG. 3. In the embodiment of the disclosure, the electronic device 300 includes a current source 310, a voltage comparator 320, an emission control unit 330 and a light emitting unit 340. The current source 310 is coupled between an operation voltage VDD_LEU and the emission control unit 330. The emission control unit 330 is further coupled to the voltage comparator 320 and the light emitting unit 340, and receives the emission enable signal EM. The light emitting unit 340 is coupled between the emission control unit 330 and a voltage VSS_LEU. The voltage VSS_LEU is lower than the operation voltage VDD_LEU. In the embodiment of the disclosure, the current source 310 is configured to output a supply current to the emission control unit 330. The voltage comparator 320 is configured to receive a voltage data VD through a data line DL, and receive a ramp signal SS through a signal line RL. The voltage comparator 320 outputs a comparison signal CS to the emission control unit 330 according to the voltage data VD and the ramp signal SS, and the emission control unit 330 outputs a driving current to the light emitting unit 340 according to the supply current, the emission enable signal EM, and the comparison signal CS. In the embodiment of the disclosure, the emission enable signal EM, the voltage data VD, and the ramp signal SS may be provided from multiple driving circuits respectively arranged out of an active area of the electronic device 300 or arranged inside the active area of the electronic device 300.

In the embodiment of the disclosure, the current source 310 includes a transistor 311, a transistor 312, and a capacitor 313. A first terminal of the transistor 311 is coupled to the data line DL and receives the voltage data VD, and a control terminal of the transistor 311 receives a pulse-amplitude modulation scan signal SPAM. A first terminal of the transistor 312 receives the operation voltage VDD_LEU, a control terminal of the transistor 312 is coupled to a second terminal of the transistor 311, and a second terminal of the transistor 312 is coupled to the emission control unit 330. A first terminal of the capacitor 313 is coupled to the second terminal of the transistor 311, and a second terminal of the capacitor 313 is coupled to the first terminal of the transistor 312. In the embodiment of the disclosure, the transistors 311 and 312 are P-type transistors. In the embodiment of the disclosure, the current source 310 receives the pulse-amplitude modulation scan signal SPAM for voltage programming on the voltage of the control terminal of the transistor 312, so as to modulate the current of the supply current outputted through the second terminal of the transistor 312.

In the embodiment of the disclosure, the voltage comparator 320 includes a plurality of transistors 321, 322, and 325, a capacitor 323, and an inverter circuit 324. A first terminal of the transistor 321 is coupled to the data line DL and receives the voltage data VD, and a control terminal of the transistor 321 receives a pulse-width modulation scan signal SPWM. A first terminal of the transistor 322 receives the ramp signal SS, a control terminal of the transistor 322 receives the emission enable signal EM, and a second terminal of the transistor 322 is coupled to a second terminal of the transistor 321. A first terminal of the capacitor 323 is coupled to the second terminal of the transistor 322 and the second terminal of the transistor 321. An input terminal of the inverter circuit 324 is coupled to a second terminal of the capacitor 323, and an output terminal of the inverter circuit 324 is coupled to the emission control unit 330. A first terminal of the transistor 325 is coupled to the input terminal of the inverter circuit 324, a control terminal of the transistor 325 receives the pulse-width modulation scan signal SPWM, and a second terminal of the transistor 325 is coupled to the output terminal of the inverter circuit 324. A voltage at the second terminal of the capacitor 323 is defined as a node voltage N1. In the embodiment of the disclosure, the transistors 321, 322 and 325 are P-type transistors. The voltage comparator 320 performs voltage programming on the voltage data VD according to the pulse-width modulation scan signal SPWM, so that the second terminal of the transistor 321 may outputs a pulse-width modulation voltage.

In the embodiment of the disclosure, the inverter circuit 324 includes a transistor 3241 and a transistor 3242. A first terminal of the transistor 3241 receives an operation voltage VDD, a control terminal of the transistor 3241 is coupled to the input terminal of the inverter circuit 324, and a second terminal of the transistor 3241 is coupled to the output terminal of the inverter circuit 324. A second terminal of the transistor 3242 receives a voltage VSS, a control terminal of the transistor 3242 is coupled to the input terminal of the inverter circuit 324, and a first terminal of the transistor 3242 is coupled to the output terminal of the inverter circuit 324. The voltage VSS is lower than the operation voltage VDD. In one embodiment, the voltage VSS may be 0V, and the operation voltage VDD may be a work voltage. In the embodiment of the disclosure, the transistor 3241 is a P-type transistor, and the transistor 3242 is an N-type transistor.

In the embodiment of the disclosure, the emission control unit 330 includes a plurality of transistors 331 to 335. A control terminal of the transistor 331 is coupled to the voltage comparator 320. A first terminal of the transistor 332 is coupled to the operation voltage VDD, a control terminal of the transistor 332 receives the emission enable signal EM, and a second terminal of the transistor 332 is coupled to a first terminal of the transistor 331. A first terminal of the transistor 333 is couple to a second terminal of the transistor 331, a control terminal of the transistor 333 is coupled to the voltage comparator 320, and a second terminal of the transistor 333 is coupled to the voltage VSS. The voltage VSS is lower than the operation voltage VDD. A first terminal of the transistor 334 is coupled to the second terminal of the transistor 331, a control terminal of the transistor 334 receives the emission enable signal EM, and a second terminal of the transistor 334 is coupled to the voltage VSS. A first terminal of the transistor 335 is coupled to the current source 310, a control terminal of the transistor 335 is coupled to the second terminal of the transistor 331, and a second terminal of the transistor 335 is coupled to the light emitting unit 340. A voltage at the control terminal of the transistor 335 is defined as a node voltage N2. In the embodiment of the disclosure, the transistors 331 and 332 are P-type transistors, and the transistors 333, 334 and 335 are N-type transistors.

Figure 4:
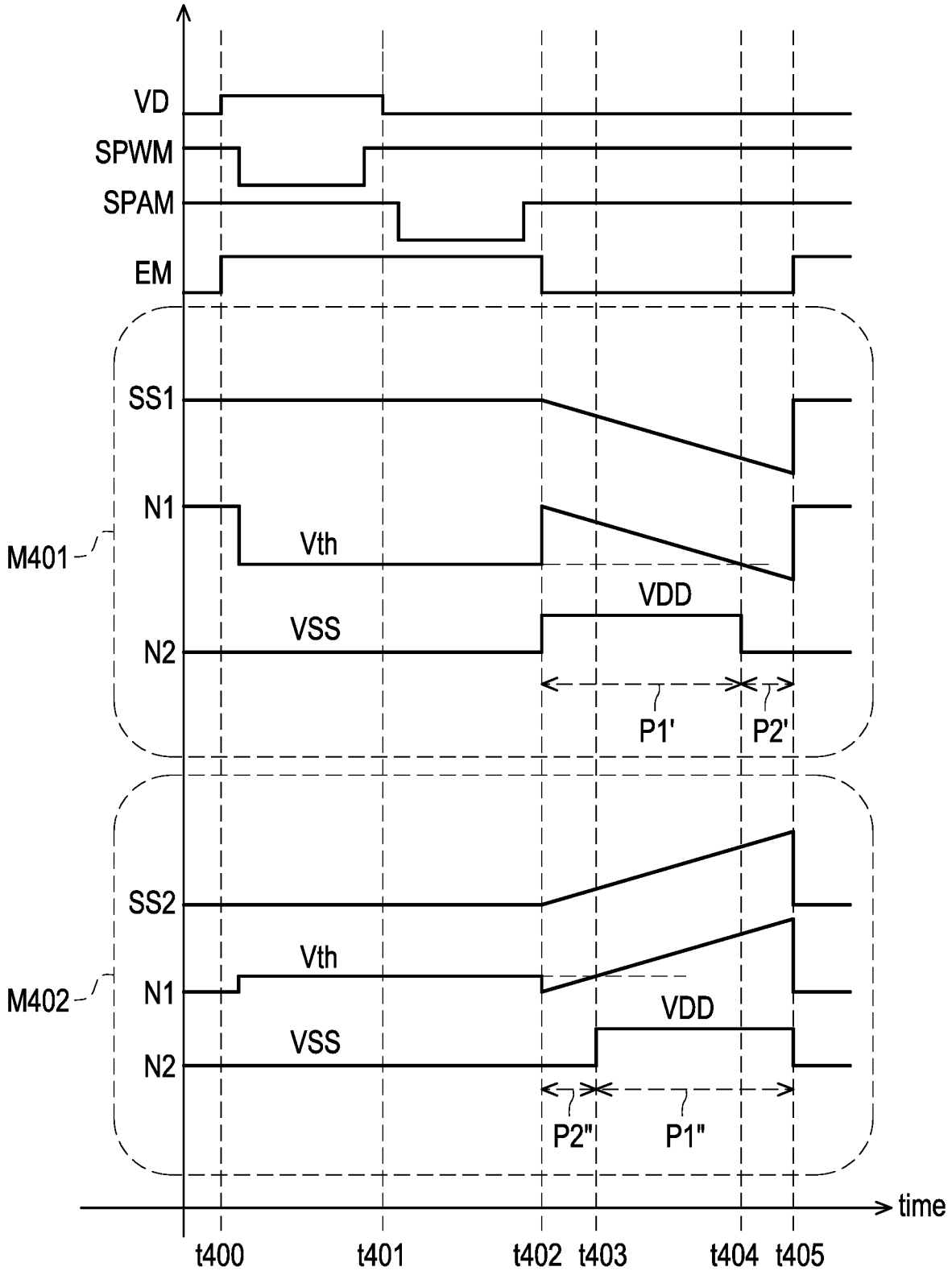
FIG. 4 is a schematic diagram of signals according to the embodiment of FIG. 3 of the disclosure.

FIG. 4 is a schematic diagram of signals according to the embodiment of FIG. 3 of the disclosure. Referring to FIG. 3 and FIG. 4, during the period from time t400 to time t401, the voltage of the pulse-width modulation scan signal SPWM changes from the high voltage level to the low voltage level, so as to turn-on the transistors 321 and 325. The data line DL transmits the voltage data VD having pulse-width modulation data. During the period from time t401 to time t402, the voltage of the pulse-amplitude modulation scan signal SPAM changes from the high voltage level to the low voltage level, so as to turn-on the transistor 311. The data line DL transmits the voltage data VD having pulse-amplitude modulation data. During the data setup period from time t400 to time t402, the voltage of the emission enable signal EM changes from the low voltage level to the high voltage level, so as to turn-off the transistors 322 and 332, and turn-on the transistor 334. During the enable period from time t402 to time t405, the voltage of the emission enable signal EM changes from the high voltage level to the low voltage level, so as to turn-on the transistors 322 and 332, and turn-off the transistor 334.

In this embodiment, the emission control unit 330 is operated in a first mode M401, and an ending time (time t404) of a first turn-on period (emission period/lighting period) P1' is determined according to the ramp signal SS, which is a first ramp signal SS1, being smaller than a threshold voltage of the comparator 320 set by the voltage data VD having the pulse-width modulation data, that is the node voltage N1, which is capacitively coupled to the ramp signal SS, being smaller than a threshold voltage Vth of the inverter 324. In one embodiment, the first ramp signal SS1 is a ramp-down signal. That is, the voltage comparator 320 may receive the first ramp signal SS1 through the capacitance 323. During the data setup period from time t400 to time t402, the first ramp signal SS1 has the high voltage level, the node voltage N1 changes from the relatively high voltage level to a threshold voltage Vth of the inverter 324 by a connection between the input and the output of the inverter 324 with the transistor 325 turned-on with the pulse-width modulation signal SPWM. During the data setup period from time t400 to time t402, due to the transistor 334 is turned-on, the node voltage N2 is maintained at the low voltage level (e.g. voltage VSS). At time t402, the first ramp signal SS1 (ramp-down signal) starts to drop down, the emission enable signal EM changes low, the transistor 323 turns on, the node voltage N1 changes from the low voltage level (threshold voltage Vth) to the relatively high voltage level by capacitive coupling with the capacitance 323 and node voltage N2 changes from the low voltage level (voltage VSS) to the high voltage level (e.g., operation voltage VDD), so that the transistor 335 is turned-on to provide the driving current to the light emitting unit 340. At time t402, the light emitting unit 340 is lighted up. During the enable period from time t402 to time t405, the voltage of the first ramp signal SS1 drops down, and the node voltage N1 synchronously drops down by capacitive coupling with the capacitance 323. After time t404, due to the node voltage N1 is lower than the threshold voltage Vth of the inverter 324, after voltage inverting, the transistor 331 is turned-off and the transistor 333 is turned-on. Thus, the node voltage N2 changes from the high voltage level (operation voltage VDD) to the low voltage level (voltage VSS), so that the transistor 335 is turned-off and the light emitting unit 340 is also turned-off. Therefore, the display device 300 can perform the effective dimming function on the light emitting unit 340.

It should be noted that, the light emitting unit 340 is lighted up first during a first turn-on period (lighting period) P1' (all light emitting units 340 are lighted up), and then the light emitting unit 340 is turned off during a first turn-off period (dimming period) P2' to perform the data setup (all light emitting units 340 are turned-off sequentially or at the same time). Notably, the time length of the first turn-on period P1' of the driving current DI is determined by the emission enable signal EM, the voltage data VD and the first ramp signal SS1. If there is a delay due to propagation delays and/or signal distortions of the emission enable signal EM and/or the first ramp signal SS1 occurs, the time length of the first turn-on period P1' and the time length of the first turn-off period P2' may be adjusted (affected) by the a first delay of the emission enable signal EM, and/or a second delay of the first ramp signal SS1, which can be seen as Mura in a display image.

In this embodiment, the emission control unit 330 is operated in a second mode M402, a starting time (time t403) of a second turn-on period (emission period/lighting period) P1" is determined according to the ramp signal SS, which is a second ramp signal SS2, being greater than the threshold voltage of the comparator 320 set by the voltage data VD having the pulse-width modulation data, that is the node voltage N1, which is capacitively coupled to the ramp signal SS, being greater than a threshold voltage Vth of the inverter 324". In one embodiment, the second ramp signal SS2 is a ramp-up signal. That is, the voltage comparator 320 may receive the second ramp signal SS2 through the capacitance 323. During the data setup period from time t400 to time t402, the second ramp signal SS2 has the low voltage level, and the node voltage N1 changes from the relatively low voltage level to the threshold voltage Vth of the inverter 324 by a connection between the input and the output of the inverter 324 with the transistor 325 turned-on with the pulse-width modulation signal SPWM. During the data setup period from time t400 to time t402, due to the transistor 334 is turned-on, the node voltage N2 is maintained at the low voltage level (voltage VSS). At time t402, the second ramp signal SS2 (ramp-up signal) starts to rise, the emission enable signal EM changes low, the transistor 323 turns on, and the node voltage N1 changes from the threshold voltage Vth of the inverter circuit 324 to the relatively low voltage level by capacitive coupling with the capacitance 323, so that the transistor 335 is turned-off and the light emitting unit 340 is also turned-off. During the period from time t402 to time t403, the voltage of the second ramp signal SS2 is rising, and the node voltage N1 is synchronously rising by capacitive coupling with the capacitance 323. After time t403, due to the node voltage N1 is higher than the threshold voltage Vth of the inverter circuit 324, after voltage inverting, the node voltage N2 changes from the low voltage level (voltage VSS) to the high voltage level (operation voltage VDD), so that the transistor 331 is turned-on and the transistor 333 is turned-off. Thus, the transistor 335 is turned-on and the light emitting unit 340 is lighted up. Therefore, the electronic device 300 can perform the effective dimming function on the light emitting unit 340.

It should be noted that the light emitting unit 340 is turned off first during the second turn-off period (dimming period) P2" to perform the data setup (all light emitting units 340 are turned-off), and then the light emitting unit 340 is lighted up during the second turn-on period (lighting period) P1" (all light-emitting units 340 are lighted up sequentially or at the same time). Notably, the time length of the second turn-on period P1" of the driving current DI is determined by the emission enable signal EM, the voltage data VD and the second ramp signal SS2. If there is a delay due to propagation delays and/or signal distortions of the emission enable signal EM and/or the second ramp signal SS2 occurs, the time length of the second turn-off period P2" and the time length of the second turn-on period P1" may be adjusted (affected) by the a first delay of the emission enable signal EM, and/or a second delay of the second ramp signal SS2, which can be seen as Mura in a display image.

Figure 5B:
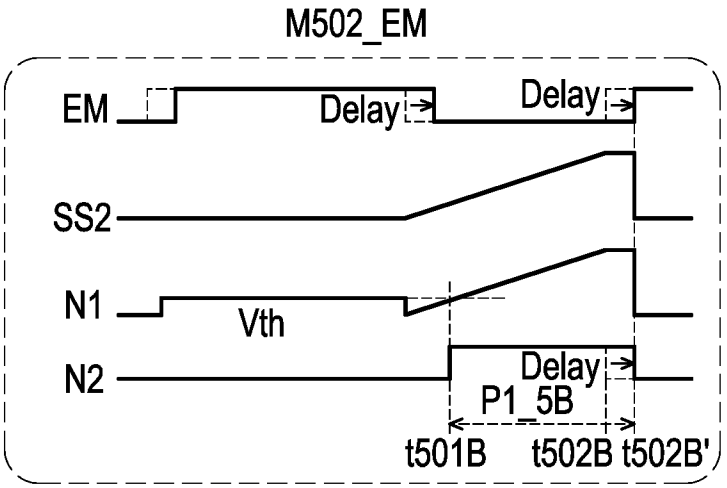
FIG. 5B is a schematic diagram of signals according to the embodiment of FIG. 3 of the disclosure.
Figure 5A:
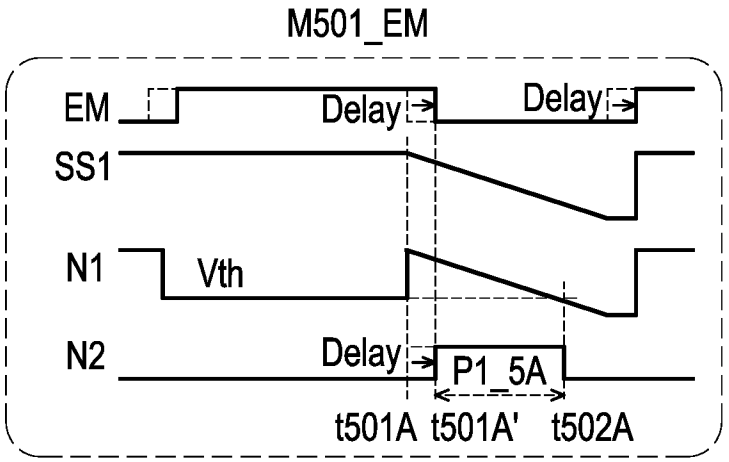
FIG. 5A is a schematic diagram of signals according to the embodiment of FIG. 3 of the disclosure.
Figure 5D:
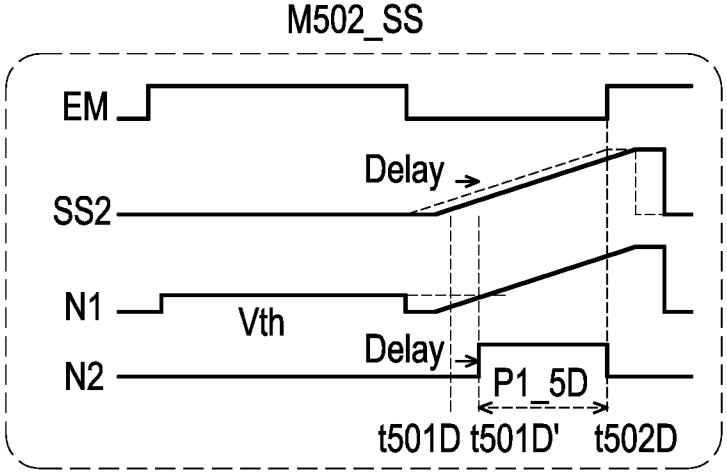
FIG. 5D is a schematic diagram of signals according to the embodiment of FIG. 3 of the disclosure.
Figure 5C:
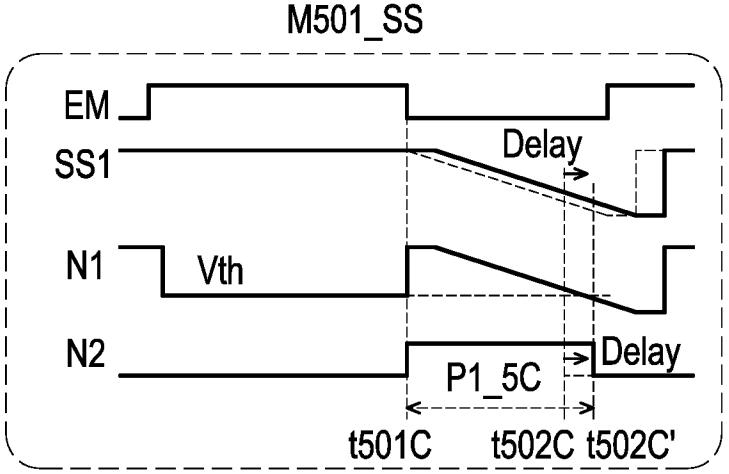
FIG. 5C is a schematic diagram of signals according to the embodiment of FIG. 3 of the disclosure.

FIG. 5A is a schematic diagram of signals according to the embodiment of FIG. 3 of the disclosure. FIG. 5B is a schematic diagram of signals according to the embodiment of FIG. 3 of the disclosure. FIG. 5C is a schematic diagram of signals according to the embodiment of FIG. 3 of the disclosure. FIG. 5D is a schematic diagram of signals according to the embodiment of FIG. 3 of the disclosure. Referring to FIG. 3 to FIG. 5D, to solve an error of the time length of the first turn-on period P1' and the time length of the second turn-on period P1" caused by the delay due to propagation delays and signal distortions of the emission enable signal EM and/or the ramp signal SS (first ramp signal SS1 and second ramp signal SS2), the arrangements of signals of FIG. 5A to FIG. 5D are provided.

Referring to FIG. 5A, in this embodiment, the emission control unit 330 is operated in a first mode M501_EM, and an ending time (time t502A) of a first turn-on period P1_5A is determined according to the first ramp signal SS1 (ramp-down signal) being smaller than the threshold voltage of the comparator 320, that is the node voltage N1 being smaller than a threshold voltage Vth of the inverter 324. In this embodiment, a delay of the emission enable signal EM occurs, and thus a starting time of the first turn-on period P1_5A is delayed from time t501A to time t501A'. Comparing with the period from time t501A to time t502A, the time length of the first turn-on period P1_5A from time t501A' to time t502A is shorter. That is, the time length of the period of the light-emitting units 340 of the pixel units being lighted up is shorter and thus a display image of the pixel units is darker.

Referring to FIG. 5B, in this embodiment, the emission control unit 330 is operated in a second mode M502_EM, and a starting time (t501B) of a second turn-on period P1_5B is determined according to the second ramp signal SS2 (ramp-up signal) being greater than the threshold voltage of the comparator 320, that is the node voltage N1 being greater than a threshold voltage Vth of the inverter 324. In this embodiment, a delay of the emission enable signal EM occurs, and thus an ending time of the second turn-on period P1_5B is delayed from time t502B to time t502B'. Comparing with the period from time t501B to time t502B, the time length of the second turn-on period P1_5B from time t501B to time t502B' is longer. That is, the time length of the period of the light-emitting units 340 of the pixel units being lighted up is longer and thus a display image of the pixel units is brighter.

It is noted that, when the emission control unit 330 is operated in the first mode M501_EM (end-adjust mode), the display image is darker due to the delay of the emission enable signal EM. In contrast, when the emission control unit 330 is operated in the second mode M502_EM (start-adjust mode), the display image is brighter due to the delay of the emission enable signal EM. That is, the influences of the delay of the emission enable signal EM to the display image are opposite when the emission control unit 330 is operated in the first mode M501_EM and the second mode M502_EM. Specifically, a time length deduction of a first time length of the first turn-on period P1_5A in the first mode M501_EM is equal to a time length increment of a second time length of the second turn-on period P1_5B in the second mode M502_EM. In other words, a brightness deduction of the first mode M501_EM is equal to a brightness increment of the second mode M502_EM.

In this manner, if the emission control unit 330 is operated in the first mode M501_EM in a first frame first and the emission control unit 330 is operated in the second mode M502_EM in a second frame right after the first frame, the display images of the first frame and the second frame will compensate to each other and thus the Mura in the display images due to propagation delays and/or signal distortions of the emission enable signal EM is cancelled. Therefore, the quality of the display images is improved.

Referring to FIG. 5C, in this embodiment, the emission control unit 330 is operated in a first mode M501_SS, and an ending time of a first turn-on period P1_5C is determined according to the first ramp signal SS1 (ramp-down signal) being smaller than the threshold voltage of the comparator 320, that is the node voltage N1 being smaller than a threshold voltage Vth of the inverter 324. In this embodiment, a delay of the first ramp signal SS1 occurs, and thus the ending time of the first turn-on period P1_5C is delayed from time t502C to time t502C'. Comparing with the period from time t501C to time t502C, the time length of the first turn-on period P1_5C from time t501C to time t502C' is longer. That is, the time length of the period of the light-emitting units 340 of the pixel units being lighted up is longer and thus a display image of the pixel units is brighter.

Referring to FIG. 5D, in this embodiment, the emission control unit 330 is operated in a second mode M502_SS, and a starting time of a second turn-on period P1_5D is determined according to the second ramp signal SS2 (ramp-up signal) being greater than the threshold voltage Vth of the comparator 320, that is the node voltage N1 being greater than a threshold voltage Vth of the inverter 324. In this embodiment, a delay of the second ramp signal SS2 occurs, and thus the starting time of the second turn-on period P1_5D is delayed from time t501D to time t501D'. Comparing with the period from time t501D to time t502D, the time length of the second turn-on period P1_5D from time t501D' to time t502D is shorter. That is, the time length of the period of the light-emitting units 340 of the pixel units being lighted up is shorter and thus a display image of the pixel units is darker.

It is noted that, when the emission control unit 330 is operated in the first mode M501_SS (end-adjust mode), the display image is brighter due to the delay of the first ramp signal SS1. In contrast, when the emission control unit 330 is operated in the second mode M502_SS (start-adjust mode), the display image is darker due to the delay of the second ramp signal SS2. That is, the influences of the delay of the ramp signal SS (first ramp signal SS1 and second ramp signal SS2) to the display image are opposite when the emission control unit 330 is operated in the first mode M501_SS and the second mode M502_SS. Specifically, a time length increment of a first time length of the first turn-on period P1_5C in the first mode M501_SS is equal to a time length deduction of a second time length of the second turn-on period P1_5D in the second mode M502_SS. In other words, a brightness increment of the first mode M501_SS is equal to a brightness deduction of the second mode M502_SS.

In this manner, if the emission control unit 330 is operated in the first mode M501_SS in a first frame first and the emission control unit 330 is operated in the second mode M502_SS in a second frame right after the first frame, the display images of the first frame and the second frame will compensate to each other and thus the Mura in the display images due to propagation delays and/or signal distortions of the first ramp signal SS1 is cancelled. Therefore, the quality of the display images is improved.

Figure 6:
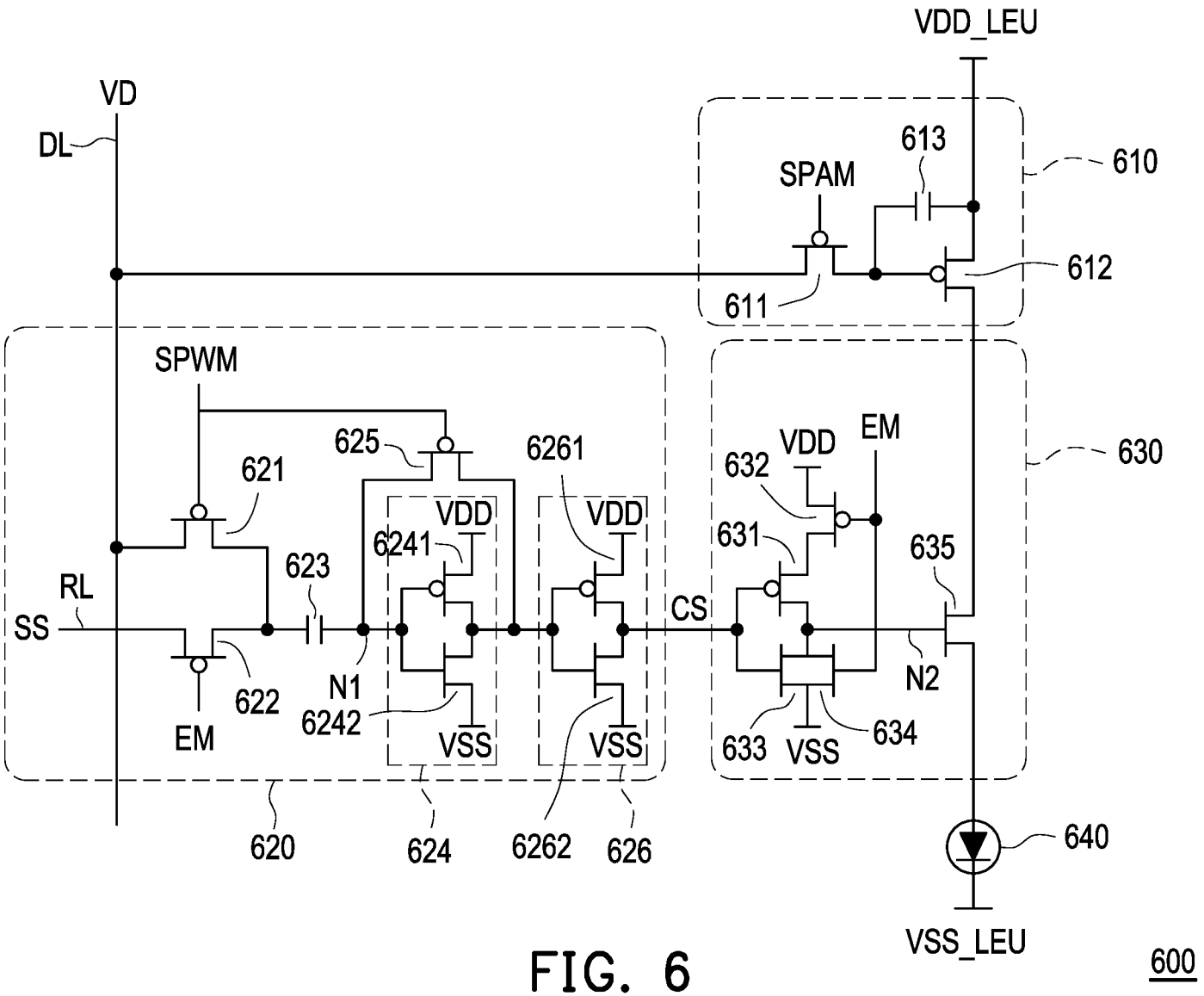
FIG. 6 is a schematic diagram of an electronic device according to an embodiment of the disclosure.

FIG. 6 is a schematic diagram of an electronic device according to an embodiment of the disclosure. Referring to FIG. 6, the electronic device 600 includes a pixel array, and the pixel array includes a plurality of pixel units. In one embodiment, the electronic device 600 may be a pixel unit, but the disclosure is not limited thereto. Each of the plurality of pixel units may include the circuit architecture as shown in FIG. 6. In the embodiment of the disclosure, the electronic device 600 includes a current source 610, a voltage comparator 620, an emission control unit 630 and a light emitting unit 640. The current source 610 is coupled between an operation voltage VDD_LEU and the emission control unit 630. The emission control unit 630 is further coupled to the voltage comparator 620 and the light emitting unit 640, and receives the emission enable signal EM. The light emitting unit 640 is coupled between the emission control unit 630 and a voltage VSS_LEU. The voltage VSS_LEU is lower than the operation voltage VDD_LEU. In the embodiment of the disclosure, the current source 610 is configured to output a supply current to the emission control unit 630. The voltage comparator 620 is configured to receive a voltage data VD through a data line DL, and receive a ramp signal SS through a signal line RL. The voltage comparator 620 outputs a comparison signal CS to the emission control unit 630 according to the voltage data VD and the ramp signal SS, and the emission control unit 630 outputs a driving current to the light emitting unit 640 according to the supply current, the emission enable signal EM, and the comparison signal CS. In the embodiment of the disclosure, the emission enable signal EM, the voltage data VD, and the ramp signal SS may be provided from multiple driving circuits respectively arranged out of an active area of the electronic device 600 or arranged inside the active area of the electronic device 600.

In the embodiment of the disclosure, the current source 610 includes a transistor 611, a transistor 612, and a capacitor 613. A first terminal of the transistor 611 is coupled to the data line DL and receives the voltage data VD, and a control terminal of the transistor 611 receives a pulse-amplitude modulation scan signal SPAM. A first terminal of the transistor 612 receives the operation voltage VDD_LEU, a control terminal of the transistor 612 is coupled to a second terminal of the transistor 611, and a second terminal of the transistor 612 is coupled to the emission control unit 630. A first terminal of the capacitor 613 is coupled to the second terminal of the transistor 611, and a second terminal of the capacitor 613 is coupled to the first terminal of the transistor 612. In the embodiment of the disclosure, the transistors 611 and 612 are P-type transistors. In the embodiment of the disclosure, the current source 610 receives the pulse-amplitude modulation scan signal SPAM for voltage programming on the voltage of the control terminal of the transistor 612, so as to modulate the current of the supply current outputted through the second terminal of the transistor 612.

In the embodiment of the disclosure, the voltage comparator 620 includes a plurality of transistors 621, 622, and 625, a capacitor 623, an inverter circuit 624, and an inverter circuit 626. A first terminal of the transistor 621 is coupled to the data line DL and receives the voltage data VD, and a control terminal of the transistor 621 receives a pulse-width modulation scan signal SPWM. A first terminal of the transistor 622 receives the ramp signal SS, a control terminal of the transistor 622 receives the emission enable signal EM, and a second terminal of the transistor 622 is coupled to a second terminal of the transistor 621. A first terminal of the capacitor 623 is coupled to the second terminal of the transistor 622 and the second terminal of the transistor 621. An input terminal of the inverter circuit 624 is coupled to a second terminal of the capacitor 623, and an output terminal of the inverter circuit 624 is coupled to the inverter circuit 626. A first terminal of the transistor 625 is coupled to the input terminal of the inverter circuit 624, a control terminal of the transistor 625 receives the pulse-width modulation scan signal SPWM, and a second terminal of the transistor 625 is coupled to the output terminal of the inverter circuit 624. An input terminal of the inverter circuit 626 is coupled to the output terminal of the inverter circuit 624, and an output terminal of the inverter circuit 626 is coupled to the emission control unit 630. A voltage at the second terminal of the capacitor 623 is defined as a node voltage N1. In the embodiment of the disclosure, the transistors 621, 622 and 625 are P-type transistors. The voltage comparator 620 performs voltage programming on the voltage data VD according to the pulse-width modulation scan signal SPWM, so that the second terminal of the transistor 621 may outputs a pulse-width modulation voltage.

In the embodiment of the disclosure, the inverter circuit 624 includes a transistor 6241 and a transistor 6242. A first terminal of the transistor 6241 receives an operation voltage VDD, a control terminal of the transistor 6241 is coupled to the input terminal of the inverter circuit 624, and a second terminal of the transistor 6241 is coupled to the output terminal of the inverter circuit 624. A second terminal of the transistor 6242 receives a voltage VSS, a control terminal of the transistor 6242 is coupled to the input terminal of the inverter circuit 624, and a first terminal of the transistor 6242 is coupled to the output terminal of the inverter circuit 624. The voltage VSS is lower than the operation voltage VDD.

In the embodiment of the disclosure, the transistor 6241 is P-type transistor, and the transistor 6242 is N-type transistor.

In the embodiment of the disclosure, the inverter circuit 626 includes a transistor 6261 and a transistor 6262. A first terminal of the transistor 6261 receives an operation voltage VDD, a control terminal of the transistor 6261 is coupled to the input terminal of the inverter circuit 626, and a second terminal of the transistor 6261 is coupled to the output terminal of the inverter circuit 626. A second terminal of the transistor 6262 receives a voltage VSS, a control terminal of the transistor 6262 is coupled to the input terminal of the inverter circuit 626, and a first terminal of the transistor 6262 is coupled to the output terminal of the inverter circuit 626. In the embodiment of the disclosure, the transistor 6261 is P-type transistor, and the transistor 6262 is N-type transistor.

In the embodiment of the disclosure, the emission control unit 630 includes a plurality of transistors 631 to 635. A control terminal of the transistor 631 is coupled to the voltage comparator 620. A first terminal of the transistor 632 is coupled to the operation voltage VDD, a control terminal of the transistor 632 receives the emission enable signal EM, and a second terminal of the transistor 632 is coupled to a first terminal of the transistor 631. A first terminal of the transistor 633 is couple to a second terminal of the transistor 631, a control terminal of the transistor 633 is coupled to the voltage comparator 620, and a second terminal of the transistor 633 is coupled to the voltage VSS. The voltage VSS is lower than the operation voltage VDD. A first terminal of the transistor 634 is coupled to the second terminal of the transistor 631, a control terminal of the transistor 634 receives the emission enable signal EM, and a second terminal of the transistor 634 is coupled to the voltage VSS. A first terminal of the transistor 635 is coupled to the current source 610, a control terminal of the transistor 635 is coupled to the second terminal of the transistor 631, and a second terminal of the transistor 635 is coupled to the light emitting unit 640. A voltage at the control terminal of the transistor 635 is defined as a node voltage N2. In the embodiment of the disclosure, the transistors 631 and 632 are P-type transistors, and the transistors 633, 634 and 635 are N-type transistors.

Figure 7:
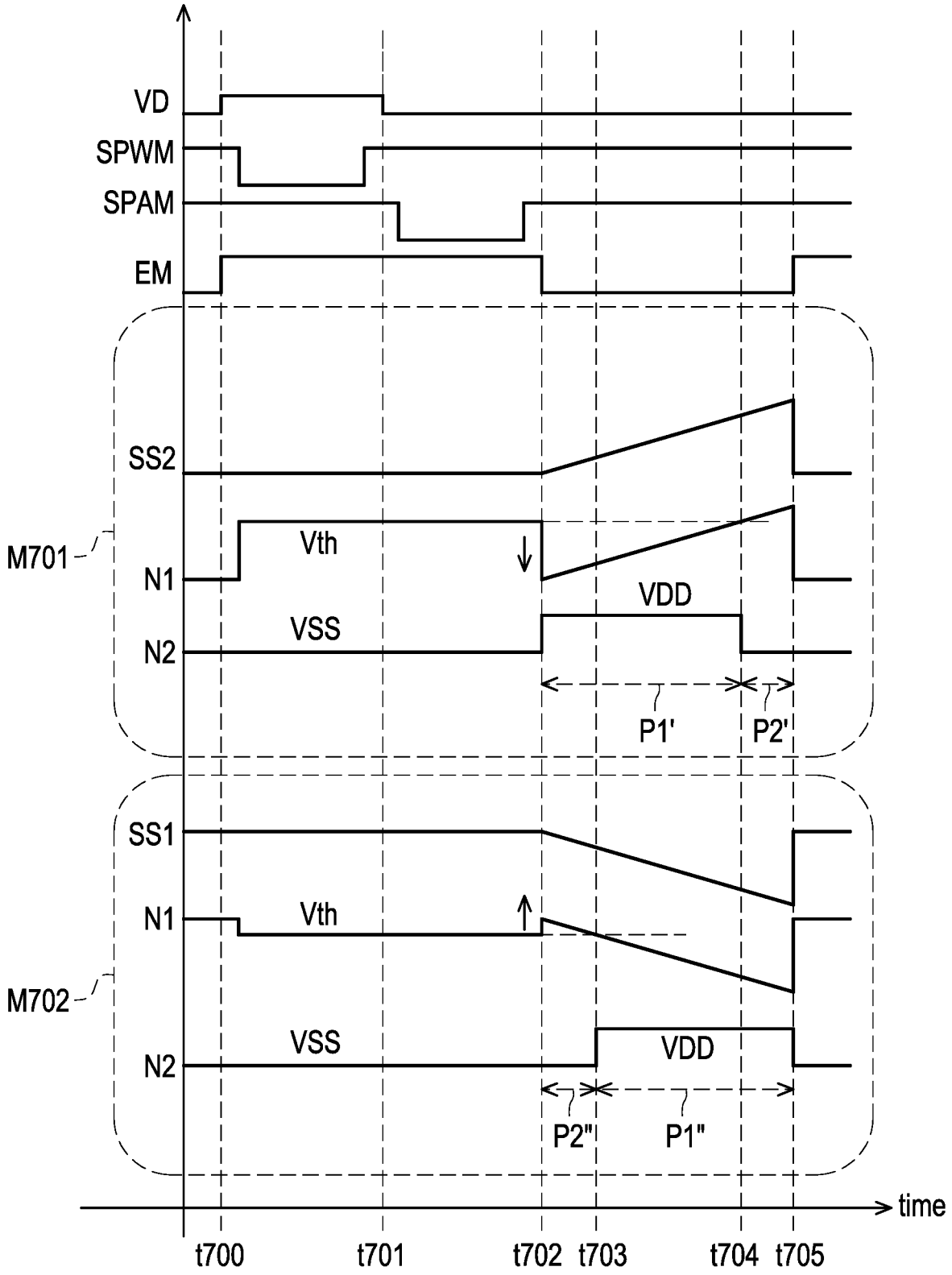
FIG. 7 is a schematic diagram of signals according to the embodiment of FIG. 6 of the disclosure.

FIG. 7 is a schematic diagram of signals according to the embodiment of FIG. 6 of the disclosure. Referring to FIG. 6 and FIG. 7, during the period from time t700 to time t701, the voltage of the pulse-width modulation scan signal SPWM changes from the high voltage level to the low voltage level, so as to turn-on the transistors 621 and 625. The data line DL transmits the voltage data VD having pulse-width modulation data. During the period from time t701 to time t702, the voltage of the pulse-amplitude modulation scan signal SPAM changes from the high voltage level to the low voltage level, so as to turn-on the transistor 611. The data line DL transmits the voltage data VD having pulse-amplitude modulation data. During the data setup period from time t700 to time t702, the voltage of the emission enable signal EM changes from the low voltage level to the high voltage level, so as to turn-off the transistors 622 and 632, and turn-on the transistor 634. During the enable period from time t702 to time t705, the voltage of the emission enable signal EM changes from the high voltage level to the low voltage level, so as to turn-on the transistors 622 and 632, and turn-off the transistor 634.

In this embodiment, the emission control unit 630 is operated in a first mode M701, and an ending time (time t704) of a first turn-on period (emission period/lighting period) P1' is determined according to the ramp signal SS, which is the second ramp signal SS2, being greater than a threshold voltage of the comparator 620 set by the voltage data VD having the pulse-width modulation data, that is the node voltage N1, which is capacitively coupled to the ramp signal SS, being greater than a threshold voltage Vth of the inverter 624. In one embodiment, the second ramp signal SS2 is a ramp-up signal. That is, the voltage comparator 620 may receive the second ramp signal SS2. During the data setup period from time t700 to time t702, the second ramp signal SS2 has the low voltage level, the node voltage N1 changes from the relatively low voltage level to the threshold voltage Vth of the inverter circuit 624. During the data setup period from time t700 to time t702, due to the transistor 634 is turned-on, the node voltage N2 is maintained at the low voltage level (voltage VSS). At time t702, the second ramp signal SS2 (ramp-up signal) starts to rise, the node voltages N1 changes from the threshold voltage Vth of the inverter circuit 624 to the relatively low voltage level by capacitive coupling with the capacitance 623, and the node voltage N2 changes from the low voltage level (voltage VSS) to the high voltage level (operation voltage VDD), so that the transistor 635 is turned-on to provide the driving current to the light emitting unit 640. At time t702, the light emitting unit 640 is lighted up. During the enable period from time t702 to time t705, the voltage of the second ramp signal SS2 is rising, and the node voltage N1 is synchronously rising by capacitive coupling with the capacitance 623. After time t704, due to the node voltage N1 is higher than the threshold voltage Vth of the inverter circuit 624, the transistor 631 is turned-off and the transistor 633 is turned-on. Thus, the node voltage N2 changes from the high voltage level (operation voltage VDD) to the low voltage level (voltage VSS), so that the transistor 635 is turned-off and the light emitting unit 640 is also turned-off. Therefore, the electronic device 600 can perform the effective dimming function on the light emitting unit 640.

It should be noted that the light emitting unit 640 is lighted up first during the first turn-on period (lighting period) P1' from time t702 to time t704 (all light emitting units 640 are lighted up), and then the light emitting unit 640 is turned off during the first turn-off period (dimming period) P2' from time t704 to time t705 to perform the data setup (all light-emitting units 640 are turned-off sequentially or at the same time). Notably, the time length of the first turn-on period P1' of the driving current DI is determined by the emission enable signal EM, the voltage data VD and the second ramp signal SS2. If there is a delay due to propagation delays and/or signal distortions of the emission enable signal EM and/or the second ramp signal SS2 occurs, the time length of the first turn-on period P1' and the time length of the first turn-off period P2' may be adjusted (affected) by the a first delay of the emission enable signal EM, and/or a second delay of the second ramp signal SS2, which can be seen as Mura in a display image.

In this embodiment, the emission control unit 630 is operated in a second mode M702, a starting time (time t702) of a second turn-on period (emission period/lighting period) P1" is determined according to the ramp signal SS, which is the first ramp signal SS1, being smaller than the threshold voltage of the comparator 620 set by the voltage data VD having the pulse-width modulation data, that is the node voltage N1, which is capacitively coupled to the ramp signal SS, being smaller than a threshold voltage Vth of the inverter 624. In one embodiment, the first ramp signal SS1 is a ramp-down signal. That is, the voltage comparator 620 may receive the first ramp signal SS1. During the data setup period from time t700 to time t702, the first ramp signal SS1 has the high voltage level, the node voltage N1 changes from the relatively high voltage level to the threshold voltage Vth of the inverter circuit 624. During the data setup period from time t700 to time t702, due to the transistor 634 is turned-on, the node voltage N2 is maintained at the low voltage level (voltage VSS). At time t702, the first ramp signal SS1 (ramp-down signal) starts to drop down, and the node voltage N1 changes from the threshold voltage Vth of the inverter circuit 624 to the relatively high voltage level by capacitive coupling with capacitor 623. The node voltage N2 is maintained at the low voltage level (voltage VSS), so that the transistor 635 is turned-off and the light emitting unit 640 is also turned-off. During the second turn-off period (dimming period) period P2" from time t702 to time t703, the voltage of the first ramp signal SS1 is dropping down, and the node voltage N1 is synchronously dropping down by capacitive coupling with capacitor 623. After time t703, due to the node voltage N1 is lower than the threshold voltage Vth of the inverter circuit 624, the node voltage N2 changes from the low voltage level (voltage VSS) to the high voltage level (operation voltage VDD), after voltage inverting, the transistor 631 is turned-on and the transistor 633 is turned-off. Thus, the transistor 635 is turned-on and the light emitting unit 640 is lighted up. Therefore, the electronic device 600 can perform the effective dimming function on the light emitting unit 640.

It should be noted that the light emitting unit 640 is turned off first during the second turn-off period (dimming period) P2" to perform the data setup (all light emitting units 640 are turned-off), and then the light emitting unit 640 is lighted up during the second turn-on period (lighting period) P1" from time t703 to time t705 (all light-emitting units 640 are lighted up sequentially or at the same time). Notably, the time length of the second turn-on period P1" of the driving current DI is determined by the emission enable signal EM, the voltage data VD and the first ramp signal SS1. If there is a delay due to propagation delays and/or signal distortions of the emission enable signal EM and/or the first ramp signal SS1 occurs, the time length of the second turn-off period P2" and the time length of the second turn-on period P1" may be adjusted (affected) by the a first delay of the emission enable signal EM, and/or a second delay of the second ramp signal SS2, which can be seen as Mura in a display image.

Figure 8A:
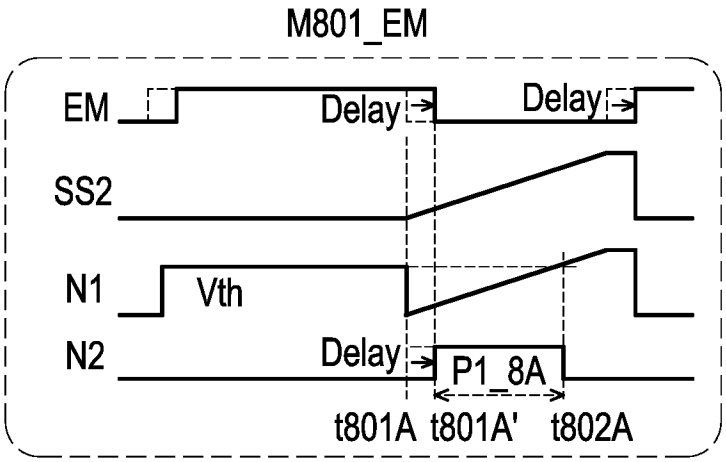
FIG. 8A is a schematic diagram of signals according to the embodiment of FIG. 6 of the disclosure.
Figure 8B:
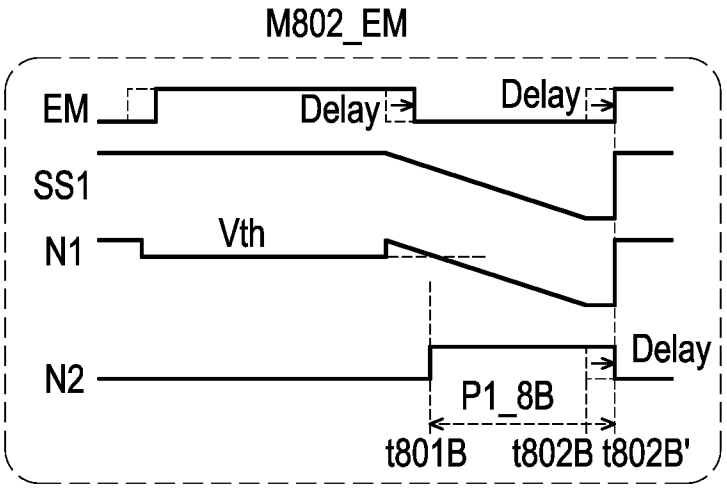
FIG. 8B is a schematic diagram of signals according to the embodiment of FIG. 6 of the disclosure.
Figure 8C:
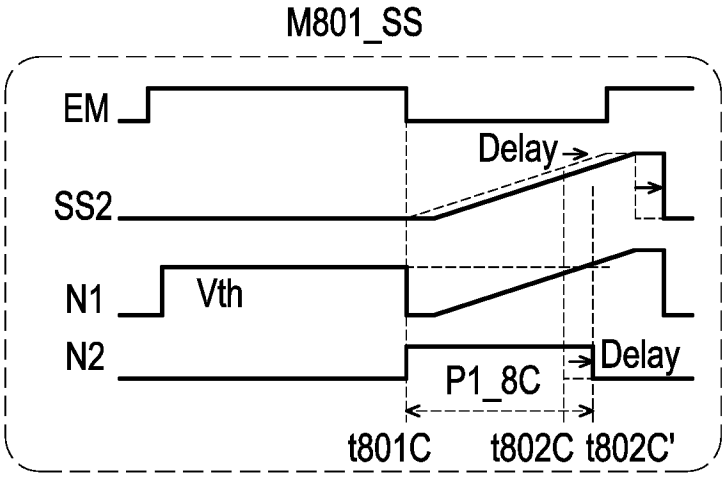
FIG. 8C is a schematic diagram of signals according to the embodiment of FIG. 6 of the disclosure.
Figure 8D:
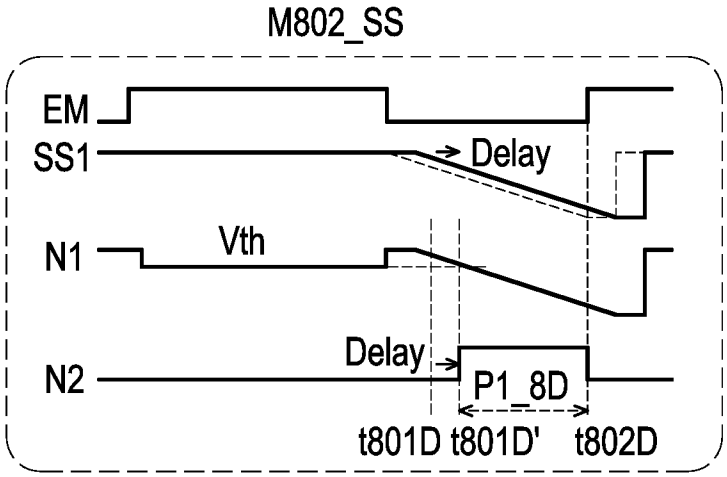
FIG. 8D is a schematic diagram of signals according to the embodiment of FIG. 6 of the disclosure.

FIG. 8A is a schematic diagram of signals according to the embodiment of FIG. 6 of the disclosure. FIG. 8B is a schematic diagram of signals according to the embodiment of FIG. 6 of the disclosure. FIG. 8C is a schematic diagram of signals according to the embodiment of FIG. 6 of the disclosure. FIG. 8D is a schematic diagram of signals according to the embodiment of FIG. 6 of the disclosure. Referring to FIG. 6 to FIG. 8D, to solve an error of the time length of the first turn-on period P1' and the time length of the second turn-on period P1" caused by the delay due to propagation delays and signal distortions of the emission enable signal EM and/or the ramp signal SS (first ramp signal SS1 and second ramp signal SS2), the arrangements of signals of FIG. 8A to FIG. 8D are provided.

Referring to FIG. 8A, in this embodiment, the emission control unit 630 is operated in a first mode M801_EM, and an ending time (time t802A) of a first turn-on period P1_8A is determined according to the second ramp signal SS2 (ramp-up signal) being greater than the threshold voltage of the comparator 620, that is the node voltage N1 being greater than a threshold voltage Vth of the inverter 624. In this embodiment, a delay of the emission enable signal EM occurs, and thus a starting time of the first turn-on period P1_8A is delayed from time t801A to time t801A'. Comparing with the period from time t801A to time t802A, the time length of the first turn-on period P1_8A from time t801A' to time t802A is shorter. That is, the time length of the period of the light-emitting units 640 of the pixel units being lighted up is shorter and thus a display image of the pixel units is darker.

Referring to FIG. 8B, in this embodiment, the emission control unit 630 is operated in a second mode M802_EM, and a starting time (t801B) of a second turn-on period P1_8B is determined according to the first ramp signal SS1 (ramp-down signal) being smaller than the threshold voltage of the comparator 620, that is the node voltage N1 being smaller than a threshold voltage Vth of the inverter 624. In this embodiment, a delay of the emission enable signal EM occurs, and thus an ending time of the second turn-on period P1_8B is delayed from time t802B to time t802B'. Comparing with the period from time t801B to time t802B, the time length of the second turn-on period P1_8B from time t801B to time t802B' is longer. That is, the time length of the period of the light-emitting units 640 of the pixel units being lighted up is longer and thus a display image of the pixel units is brighter.

It is noted that, when the emission control unit 630 is operated in the first mode M801_EM (end-adjust mode), the display image is darker due to the delay of the emission enable signal EM. In contrast, when the emission control unit 630 is operated in the second mode M802_EM (start-adjust mode), the display image is brighter due to the delay of the emission enable signal EM. That is, the influences of the delay of the emission enable signal EM to the display image are opposite when the emission control unit 630 is operated in the first mode M801_EM and the second mode M802_EM. Specifically, a time length deduction of a first time length of the first turn-on period P1_8A in the first mode M801_EM is equal to a time length increment of a second time length of the second turn-on period P1_8B in the second mode M802_EM. In other words, a brightness deduction of the first mode M801_EM is equal to a brightness increment of the second mode M802_EM.

In this manner, if the emission control unit 630 is operated in the first mode M801_EM in a first frame first and the emission control unit 630 is operated in the second mode M802_EM in a second frame right after the first frame, the display images of the first frame and the second frame will compensate to each other and thus the Mura in the display images due to propagation delays and/or signal distortions of the emission enable signal EM is cancelled. Therefore, the quality of the display images is improved.

Referring to FIG. 8C, in this embodiment, the emission control unit 630 is operated in a first mode M801_SS, and an ending time of a first turn-on period P1_8C is determined according to the second ramp signal SS1 (ramp-up signal) being greater than the threshold voltage of the comparator 620, that is the node voltage N1 being greater than a threshold voltage Vth of the inverter 624. In this embodiment, a delay of the second ramp signal SS2 occurs, and thus the ending time of the first turn-on period P1_8C is delayed from time t802C to time t802C'. Comparing with the period from time t801C to time t802C, the time length of the first turn-on period P1_8C from time t801C to time t802C' is longer. That is, the time length of the period of the light-emitting units 640 of the pixel units being lighted up is longer and thus a display image of the pixel units is brighter.

Referring to FIG. 8D, in this embodiment, the emission control unit 630 is operated in a second mode M802_SS, and a starting time of a second turn-on period P1_8D is determined according to the first ramp signal SS1 (ramp-down signal) being smaller than the threshold voltage of the comparator 620, that is the node voltage N1 being smaller than a threshold voltage Vth of the inverter 624. In this embodiment, a delay of the first ramp signal SS1 occurs, and thus the starting time of the second turn-on period P1_8D is delayed from time t801D to time t801D'. Comparing with the period from time t801D to time t802D, the time length of the second turn-on period P1_8D from time t801D' to time t802D is shorter. That is, the time length of the period of the light-emitting units 640 of the pixel units being lighted up is shorter and thus a display image of the pixel units is darker.

It is noted that, when the emission control unit 630 is operated in the first mode M801_SS (end-adjust mode), the display image is brighter due to the delay of the second ramp signal SS2. In contrast, when the emission control unit 630 is operated in the second mode M802_SS (start-adjust mode), the display image is darker due to the delay of the first ramp signal SS1. That is, the influences of the delay of the ramp signal SS (first ramp signal SS1 and second ramp signal SS2) to the display image are opposite when the emission control unit 630 is operated in the first mode M801_SS and the second mode M802_SS. Specifically, a time length increment of a first time length of the first turn-on period P1_8C in the first mode M801_SS is equal to a time length deduction of a second time length of the second turn-on period P1_8D in the second mode M802_SS. In other words, a brightness increment of the first mode M801_SS is equal to a brightness deduction of the second mode M802_SS.

In this manner, if the emission control unit 630 is operated in the first mode M801_SS in a first frame first and the emission control unit 630 is operated in the second mode M802_SS in a second frame right after the first frame, the display images of the first frame and the second frame will compensate to each other and thus the Mura in the display images due to propagation delays and/or signal distortions of the ramp signal SS is cancelled. Therefore, the quality of the display images is improved.

Figure 9B:
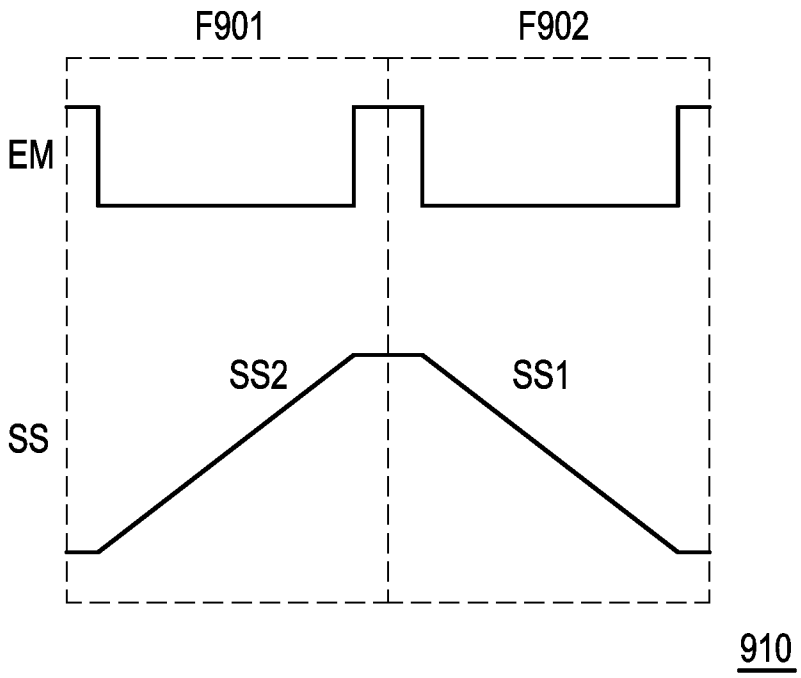
FIG. 9B is a schematic diagram of signals according to the embodiment of FIG. 9A of the disclosure.
Figure 9A:
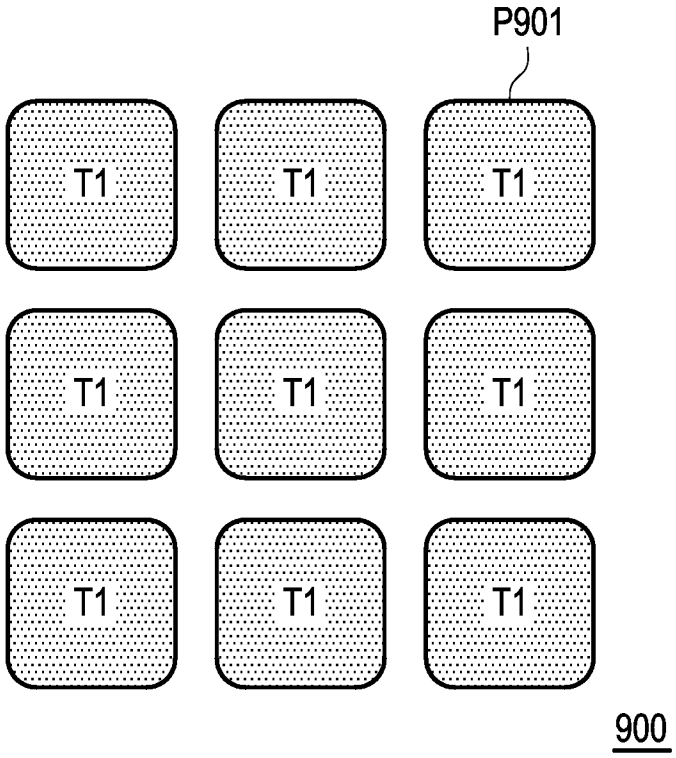
FIG. 9A is a schematic diagram of a pixel array of an electronic device according to an embodiment of the disclosure.

FIG. 9A is a schematic diagram of a pixel array of an electronic device according to an embodiment of the disclosure. FIG. 9B is a schematic diagram of signals according to the embodiment of FIG. 9A of the disclosure. Referring to FIG. 3 to FIG. 5D, FIG. 9A and FIG. 9B, an electronic device includes a pixel array 900, and the pixel array 900 includes a plurality of first pixel units P901. Each of the plurality of first pixel units P901 may include the circuit architecture as shown in FIG. 3, the pixel array may be arranged as shown in FIG. 9A, and the signals of the first pixel units P901 may be arranged as the timing chart 910 shown in FIG. 9B.

Referring to FIG. 3, an inverter 324 is arranged in the voltage comparator 320, and thus the comparison signal is inverted before providing to the emission control unit 330. In other words, the emission control unit 330 is configured to receive an inverted comparison signal. Therefore, the pixel unit P901 of the electronic device may be called an inverting type pixel unit, which is depicted as a first type T1 in FIG. 9A.

Referring to FIG. 5A to FIG. 5D and FIG. 9B, the influences of the delay of the emission enable signal EM to the display image are opposite when the emission control unit 330 is operated in the first mode M501_EM and the second mode M502_EM. Also, the influences of the delay of the ramp signal SS (first ramp signal SS1 and second ramp signal SS2) to the display image are opposite when the emission control unit 330 is operated in the first mode M501_SS and the second mode M502_SS.

In this manner, the first mode M501_EM/M501_SS (end-adjust mode) and the second mode M502_EM/M502_SS (start-adjust mode) of the emission control unit 330 of the first pixel units P901 may be arranged temporal alternatively to cancel the influences of the delay of the emission enable signal EM and/or the ramp signal SS (first ramp signal SS1 and second ramp signal SS2). In one embodiment, the emission control unit 330 is operated in the second mode M502_EM/M502_SS (start-adjust mode) based on the second ramp signal SS2 (ramp-up signal) in a first frame F901 and the emission control unit 330 is operated in the first mode M501_EM/M501_SS (end-adjust mode) based on the first ramp signal SS1 (ramp-down signal) in a second frame F902 after the first frame F901, the display images of the first frame F901 and the second frame F902 will compensate to each other. Therefore, the Mura in the display images due to propagation delays and/or signal distortions of the emission enable signal EM and/or the ramp signal SS is cancelled and the quality of the display images is improved.

Figure 10B:
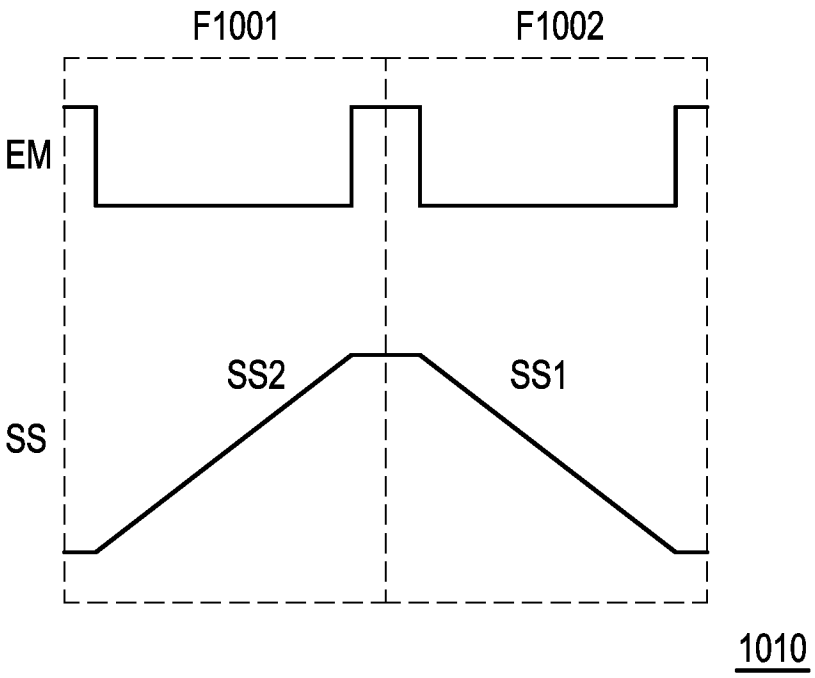
FIG. 10B is a schematic diagram of signals according to the embodiment of FIG. 10A of the disclosure.
Figure 10A:
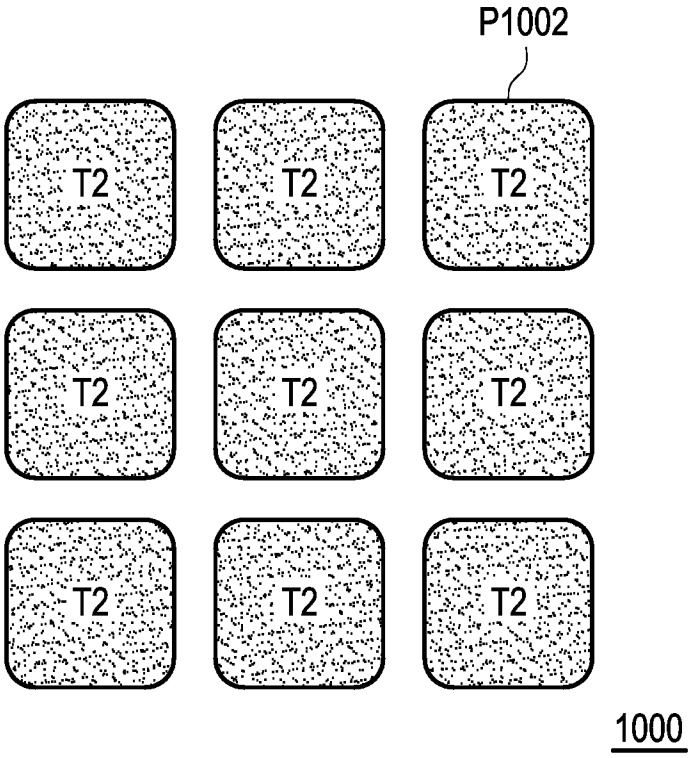
FIG. 10A is a schematic diagram of a pixel array of an electronic device according to an embodiment of the disclosure.

FIG. 10A is a schematic diagram of a pixel array of an electronic device according to an embodiment of the disclosure. FIG. 10B is a schematic diagram of signals according to the embodiment of FIG. 10A of the disclosure. Referring to FIG. 6 to FIG. 8D, FIG. 10A and FIG. 10B, an electronic device includes a pixel array 1000, and the pixel array 1000 includes a plurality of second pixel units P1002. Each of the plurality of second pixel units P1002 may include the circuit architecture as shown in FIG. 6, the pixel array may be arranged as shown in FIG. 10A, and the signals of the second pixel units P1002 may be arranged as the timing chart 1010 shown in FIG. 10B.

Referring to FIG. 6, an inverter 624 and an inverter 626 are arranged in the voltage comparator 620, and thus the comparison signal is non-inverted (inverted twice) before providing to the emission control unit 630. In other words, the emission control unit 630 is configured to receive a non-inverted comparison signal. Therefore, the pixel unit P1002 of the electronic device may be called a non-inverting type pixel unit, which is depicted as a second type T2 in FIG. 10A.

Referring to FIG. 8A to FIG. 8D and FIG. 10B, the influences of the delay of the emission enable signal EM to the display image are opposite when the emission control unit 630 is operated in the first mode M801_EM and the second mode M802_EM. Also, the influences of the delay of the ramp signal SS (first ramp signal SS1 and second ramp signal SS2) to the display image are opposite when the emission control unit 630 is operated in the first mode M801_SS and the second mode M802_SS.

In this manner, the first mode M801_EM/M801_SS (end-adjust mode) and the second mode M802_EM/M802_SS (start-adjust mode) of the emission control unit 630 of the second pixel units P1002 may be arranged temporal alternatively to cancel the influences of the delay of the emission enable signal EM and/or the ramp signal SS (first ramp signal SS1 and second ramp signal SS2). In one embodiment, the emission control unit 630 is operated in the first mode M801_EM/M801_SS (end-adjust mode) based on the second ramp signal SS2 (ramp-up signal) in a first frame F1001 and the emission control unit 630 is operated in the second mode M802_EM/M802_SS (start-adjust mode) based on the first ramp signal SS1 (ramp-down signal) in a second frame F1002 after the first frame F1001, the display images of the first frame F1001 and the second frame F1002 will compensate to each other. Therefore, the Mura in the display images due to propagation delays and/or signal distortions of the emission enable signal EM and/or the ramp signal SS is cancelled and the quality of the display images is improved.

Figures 11A, 11B, 11C, 11D:
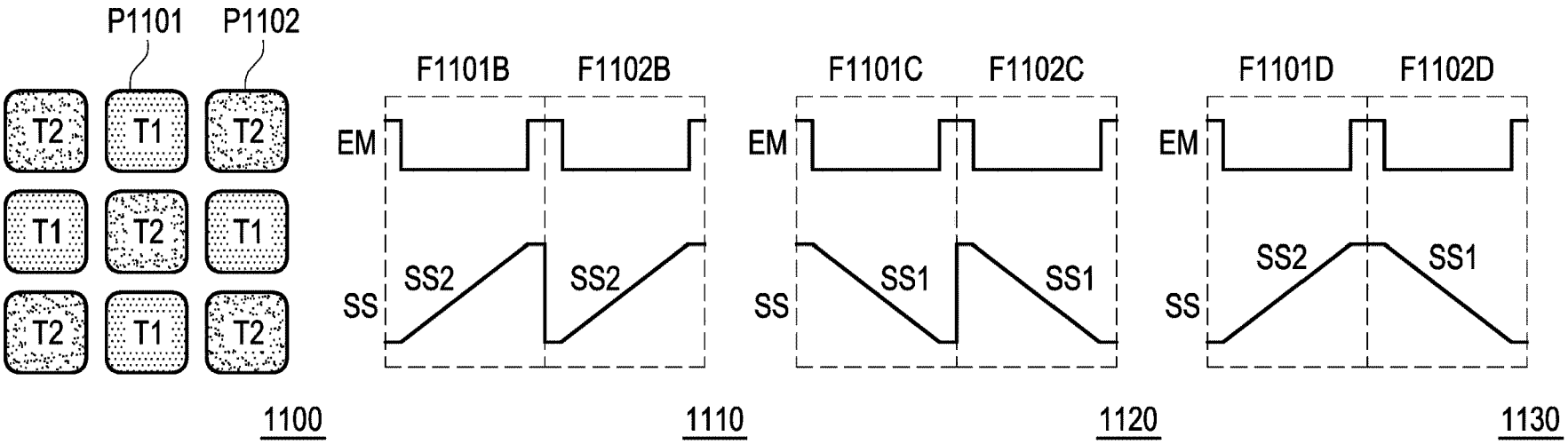
FIG. 11A is a schematic diagram of a pixel array of an electronic device according to an embodiment of the disclosure.
FIG. 11B is a schematic diagram of signals according to the embodiment of FIG. 11A of the disclosure.
FIG. 11C is a schematic diagram of signals according to the embodiment of FIG. 11A of the disclosure.
FIG. 11D is a schematic diagram of signals according to the embodiment of FIG. 11A of the disclosure.

FIG. 11A is a schematic diagram of a pixel array of an electronic device according to an embodiment of the disclosure. FIG. 11B is a schematic diagram of signals according to the embodiment of FIG. 11A of the disclosure. FIG. 11C is a schematic diagram of signals according to the embodiment of FIG. 11A of the disclosure. FIG. 11D is a schematic diagram of signals according to the embodiment of FIG. 11A of the disclosure. Referring to FIG. 9A to FIG. 11D, an electronic device includes a pixel array 1100, and the pixel array 1100 includes a plurality of pixel units. The plurality of pixel units are divided into a plurality of first pixel units P1101 and a plurality of second pixel units P1102, and the plurality of the first pixel units P1101 and the plurality of second pixel units are staggered. Referring to FIG. 9A, the pixel units P1101 of the electronic device may be called the inverting type pixel unit, which is depicted as a first type T1 in FIG. 11A. Referring to FIG. 10A, the pixel units P1102 of the electronic device may be called the non-inverting type pixel unit, which is depicted as a second type T2 in FIG. 11A. The detail of the first pixel units P1101 and the second pixel units P1102 may refer to the description of the first pixel units P901 of FIG. 9A and the description of the second pixel units P1002 of FIG. 10A, while the details are not redundantly described seriatim herein. Further, the signals of the first pixel unit P1101 and the second pixel unit P1102 may be arranged as the timing charts 1110, time chart 1120 and timing chart 1130 shown in FIG. 11B, FIG. 11C and FIG. 11D.

In one embodiment, the plurality of pixel units (first pixel units P1101 and second pixel units P1102) are configured to respectively receive a plurality of emission enable signals, a plurality of voltage data, and a common ramp signal, and the plurality of pixel units are configured to be lighted up during a plurality of emission periods according to the plurality of emission enable signals, the plurality of voltage data, and the ramp signal respectively. In the embodiment of the disclosure, the plurality emission enable signal, the voltage data, and the common ramp signal may be provided from multiple driving circuits respectively arranged out of an active area of the electronic device or arranged inside the active area of the electronic device through a data line and/or a scan line.

Further, each of the plurality of the pixel units P1101 includes a first emission control unit, and each of the plurality of second pixel units P1102 includes a second emission control unit. Since the first pixel units P1101 are the inverting type pixel units (first type T1), the first emission control unit is configured to receive a first comparison signal (inverted). Similarly, since the first pixel units P1102 are the non-inverting type pixel unit (second type T2), and the second emission control unit is configured to receive a second comparison signal (non-inverted). That is, the second comparison signal has inverted logic to the first comparison signal.

Furthermore, the first emission control unit of the first pixel units P1101 is configured to be operated in a first mode based on the common ramp signal, and the second emission control unit of the second pixel units P1102 is configured to be operated in a second mode different from the first mode based on the common ramp signal. In the embodiment, referring to FIG. 5A to FIG. 5D and FIG. 8A to FIG. 8D, the influences of the delay of the emission enable signal to the display image are opposite when the first pixel units P1101 (inverting type pixel units) and the second pixel units P1102 (non-inverting type pixel units) are operated in different modes (end-adjust mode and start-adjust mode) based on a same ramp signal (common ramp signal). Similarly, the influences of the delay of the common ramp signal to the display image are opposite when the first pixel units P1101 (inverting type pixel units) and the second pixel units P1102 (non-inverting type pixel units) are operated in different modes (end-adjust mode and start-adjust mode) based on a same ramp signal (common ramp signal).

In this manner, the first pixel units P1101 (inverting type pixel units) and the second pixel units P1102 (non-inverting type pixel units) may be arranged to be spatially staggered to cancel the influences of the delay of the emission enable signal and/or the common ramp signal.

In one embodiment, referring to FIG. 11B, during the first frame F1101B and the second frame F1102B after the first frame F1101B, the common ramp signal is the second ramp signal (ramp-up signal) and thus the first mode is the start-adjust mode and the second mode is the end-adjust mode. When the first emission control units of the first pixel units P1101 are operated in the first mode (start-adjust mode), a starting time of a first turn-on period of the first pixel units is determined according to the common ramp signal being greater than the threshold voltage of the comparator. When the second emission control units of the second pixel units P1102 are operated in the second mode (end-adjust mode), an ending time of the second turn-on period of the second pixel units is determined according to the common ramp signal being greater than the threshold voltage of the comparator. Therefore, the Mura in the display images due to propagation delays and/or signal distortions of the emission enable signal and/or the common ramp signal is cancelled spatially and the quality of the display images is improved.

In one embodiment, referring to FIG. 11C, during the first frame F1101C and the second frame F1102C after the first frame F1101C, the common ramp signal is the first ramp signal (ramp-down signal) and thus the first mode is the end-adjust mode and the second mode is the start-adjust mode. When the first emission control units of the first pixel units P1101 are operated in the first mode (end-adjust mode), a ending time of a first turn-on period of the first pixel units is determined according to the common ramp signal being smaller than a threshold voltage of the comparator. When the second emission control units of the second pixel units P1102 are operated in the second mode (start-adjust mode), an starting time of the second turn-on period of the second pixel units is determined according to the common ramp signal being smaller than the threshold voltage of the comparator. Therefore, the Mura in the display images due to propagation delays and/or signal distortions of the emission enable signal and/or the common ramp signal is cancelled spatially and the quality of the display images is improved.

In addition, the cancellation may be done temporally and spatially. In one embodiment, referring to FIG. 11D, during the first frame F1101D, the common ramp signal is the second ramp signal (ramp-up signal) and thus the first emission control unit is operated in the start-adjust mode (i.e., the first mode is the start-adjust mode) and the second emission control unit is operated in the end-adjust mode (i.e., the second mode is the end-adjust mode). During the second frame F1102D after the first frame F1101D, the common ramp signal is the first ramp signal (ramp-down signal) and thus the first emission control unit is operated in the end-adjust mode (i.e., the first mode is the end-adjust mode) and the second emission control unit is operated in the start-adjust mode (i.e., the second mode is the start-adjust mode). Therefore, the Mura in the display images due to propagation delays and/or signal distortions of the emission enable signal and/or the common ramp signal is cancelled temporally and spatially and the quality of the display images is improved.

It is noted that the arrangement of the pixel array 1100 is just an exemplary embodiment that the first pixel units P1101 and the second pixel units P1102 are staggered by a pixel unit, but the disclosure is not limited thereto. In one embodiment, the first pixel units P1101 and the second pixel units P1102 may be staggered by less than one pixel unit (e.g., half pixel unit). In one embodiment, the first pixel units P1101 and the second pixel units P1102 may be staggered by two or more pixel units.

In summary, the electronic device of the disclosure is capable of cancelling the Mura in the display images due to propagation delays and/or signal distortions by temporally and/or spatially compensation with the signal arrangement and/or pixel arrangement. Therefore the quality of the display image is improved.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An electronic device, comprising:

a light emitting unit;

a current source, configured to output a supply current;

a voltage comparator, configured to receive a voltage data and a ramp signal and output a comparison signal according to the voltage data and the ramp signal; and an emission control unit, coupled to the light emitting unit, the current source, and the voltage comparator, wherein the emission control unit is configured to receive an emission enable signal and the comparison signal, and output a driving current to the light emitting unit according to the supply current, the emission enable signal, and the comparison signal, wherein the ramp signal is a first ramp signal during a first frame, and the ramp signal is a second ramp signal different from the first ramp signal during a second frame after the first frame, wherein the emission control unit is configured to be operated in a first mode based on the first ramp signal, and the emission control unit is configured to be operated in a second mode different from the first mode based on the second ramp signal.

2. The electronic device according to claim 1, wherein a time length of a turn-on period of the driving current is determined by the emission enable signal, voltage data and the ramp signal.

3. The electronic device according to claim 1, wherein when the emission control unit is operated in the first mode, the first ramp signal is a ramp-down signal and the turn-on period is a first turn-on period, a starting time is of the first turn-on period determined by the emission enable signal, an ending time of the first turn-on period is determined according to the first ramp signal being smaller than a threshold voltage of the voltage comparator set with the voltage data.

4. The electronic device according to claim 3, wherein when the emission control unit is operated in the second mode, the second ramp signal is a ramp-up signal and the turn-on period is a second turn-on period, a starting time of the second turn-on period is determined according to the second ramp signal being greater than a threshold voltage of the voltage comparator set with the voltage data, an ending time of the second turn-on period is determined by the emission enable signal.

5. The electronic device according to claim 4, wherein a first time length of the first turn-on period is adjusted by the a first delay of the emission enable signal, and/or a second delay of the first ramp signal, a second time length of the second turn-on period is adjusted by the a first delay of the emission enable signal, and/or a second delay of the second ramp signal, and a time length deduction of the first time length is equal to a time length increment of the second time length or a time length increment of the first time length is equal to a time length deduction of the second time length.

6. The electronic device according to claim 1, wherein the voltage comparator further receives a pulse-width modulation scan signal, and performs voltage programming on the voltage data according to the pulse-width modulation scan signal.

7. The electronic device according to claim 6, wherein the voltage comparator comprises:

a first transistor, wherein a first terminal of the first transistor is coupled to a data line and receives the voltage data, and a control terminal of the first transistor receives the pulse-width modulation scan signal;

a second transistor, wherein a first terminal of the second transistor receives the ramp signal, a control terminal of the second transistor receives the emission enable signal, and a second terminal of the second transistor is coupled to a second terminal of the first transistor;

a first capacitor, wherein a first terminal of the first capacitor is coupled to the second terminal of the second transistor and the second terminal of the first transistor;

a first inverter circuit, wherein an input terminal of the first inverter circuit is coupled to a second terminal of the first capacitor, and an output terminal of the first inverter circuit is coupled to the emission control unit; and a third transistor, wherein a first terminal of the third transistor is coupled to the input terminal of the first inverter circuit, a control terminal of the third transistor receives the pulse-width modulation scan signal, and a second terminal of the third transistor is coupled to the output terminal of the first inverter circuit.

8. The electronic device according to claim 7, wherein the first inverter circuit comprises:

a fourth transistor, wherein a first terminal of the fourth transistor receives an operation voltage, a control terminal of the fourth transistor is coupled to the input terminal of the first inverter circuit, and a second terminal of the fourth transistor is coupled to the output terminal of the first inverter circuit; and a fifth transistor, wherein a second terminal of the fifth transistor receives a voltage, a control terminal of the fifth transistor is coupled to the input terminal of the first inverter circuit, and a first terminal of the fifth transistor is coupled to the output terminal of the first inverter circuit.

9. The electronic device according to claim 7, wherein the voltage comparator further comprises:

a second inverter circuit, wherein an input terminal of the second inverter circuit is coupled to the output terminal of the first inverter circuit, and an output terminal of the second inverter circuit is coupled to the emission control unit.

10. The electronic device according to claim 1, wherein when the emission control unit is operated in the first mode, the first ramp signal is a ramp-up signal and the turn-on period is a first turn-on period, a starting time of the first turn-on period is determined by the emission enable signal, an ending time of the first turn-on period is determined according to the first ramp signal being greater than a threshold voltage of the voltage comparator set with the voltage data.

11. The electronic device according to claim 10, wherein when the emission control unit is operated in the second mode, the second ramp signal is a ramp-down signal and the turn-on period is a second turn-on period, a starting time of the first turn-on period is determined according to the first ramp signal being smaller than a threshold voltage of the voltage comparator set with the voltage data, an ending time of the first turn-on period is determined by the emission enable signal.

12. The electronic device according to claim 1, wherein the emission control unit comprises:

a sixth transistor, wherein a control terminal of the sixth transistor is coupled to the voltage comparator;

a seventh transistor, wherein a first terminal of the seventh transistor is coupled to an operation voltage, a control terminal of the seventh transistor receives the emission enable signal, and a second terminal of the seventh transistor is coupled to a first terminal of the sixth transistor;

an eighth transistor, wherein a first terminal of the eighth transistor is couple to a second terminal of the sixth transistor, a control terminal of the eighth transistor is coupled to the voltage comparator, and a second terminal of the eighth transistor is coupled to a voltage;

a ninth transistor, wherein a first terminal of the ninth transistor is coupled to the second terminal of the sixth transistor, a control terminal of the ninth transistor receives the emission enable signal, and a second terminal of the ninth transistor is coupled to the voltage; and a tenth transistor, wherein a first terminal of the tenth transistor is coupled to the current source, a control terminal of the tenth transistor is coupled to the second terminal of the sixth transistor, and a second terminal of the tenth transistor is coupled to the light emitting unit.

13. The electronic device according to claim 1, wherein the current source further receives a pulse-amplitude modulation scan signal for voltage programming.

14. The electronic device according to claim 13, wherein the current source comprises:

an eleventh transistor, wherein a first terminal of the eleventh transistor is coupled to a data line and receives the voltage data, and a control terminal of the eleventh transistor receives the pulse-amplitude modulation scan signal;

a twelfth transistor, wherein a first terminal of the twelfth transistor receives an operation voltage, a control terminal of the twelfth transistor is coupled to a second terminal of the eleventh transistor, and a second terminal of the twelfth transistor is coupled to the emission control unit; and a second capacitor, wherein a first terminal of the second capacitor is coupled to the second terminal of the eleventh transistor, and a second terminal of the second capacitor is coupled to the first terminal of the twelfth transistor.

15. The electronic device according to claim 11, wherein a first time length of the first turn-on period is adjusted by the a first delay of the emission enable signal, and/or a second delay of the first ramp signal, a second time length of the second turn-on period is adjusted by the a first delay of the emission enable signal, and/or a second delay of the second ramp signal, and a time length deduction of the first time length is equal to a time length increment of the second time length or a time length increment of the first time length is equal to a time length deduction of the second time length.

16. An electronic device, comprising:

a pixel array, comprising a plurality of pixel units, wherein the plurality of pixel units are divided into a plurality of first pixel units and a plurality of second pixel units, and the plurality of the first pixel units and the plurality of the second pixel units are staggered, wherein the plurality of pixel units are configured to respectively receive a plurality of emission enable signals, a plurality of voltage data, and a common ramp signal, and the plurality of pixel units are configured to be lighted up during a plurality of emission periods according to the plurality of emission enable signals, the plurality of voltage data, and the ramp signal respectively, wherein each of the plurality of first pixel units comprises a first emission control unit, and each of the plurality of second pixel units comprises a second emission control unit, wherein the first emission control unit is configured to receive a first comparison signal and the second emission control common unit is configured to receive a second comparison signal, wherein the second comparison signal has inverted logic to the first comparison signal, wherein the first emission control unit is configured to be operated in a first mode based on the common ramp signal, and the second emission control unit is configured to be operated in a second mode different from the first mode based on the common ramp signal.

17. The electronic device according to claim 16, wherein the common ramp signal is a ramp-up signal, the first mode is a start-adjust mode and the second mode is an end-adjust mode, when the first emission control unit is operated in the first mode, a starting time of a first turn-on period of the first pixel units is determined according to the common ramp signal being greater than a threshold voltage of the voltage comparator set with the voltage data, and an ending time of the first turn-on period is determined by the emission enable signal, when the second emission control unit is operated in the second mode, a starting time of the second turn-on period is determined by the emission enable signal, and an ending time of the second turn-on period of the second pixel units is determined according to the common ramp signal being greater than the threshold voltage.

18. The electronic device according to claim 16, wherein the common ramp signal is a ramp-down signal, the first mode is an end-adjust mode and the second mode is a start-adjust mode, when the first emission control unit is operated in the first mode, a starting time of the first turn-on period is determined by the emission enable signal, and an ending time of a first turn-on period of the first pixel units is determined according to the common ramp signal being smaller than a threshold voltage of the voltage comparator set with the voltage data, when the second emission control unit is operated in the second mode, a starting time of the second turn-on period of the second pixel units is determined according to the common ramp signal being smaller than the threshold voltage, and an ending time of the second turn-on period is determined by the emission enable signal.

19. The electronic device according to claim 16, wherein during a first frame, the common ramp signal is a ramp-up signal, the first mode is a start-adjust mode and the second mode is an end-adjust mode, during a second frame after the first frame, the common ramp signal is a ramp-down signal, the first mode is an end-adjust mode and the second mode is a start-adjust mode.

* * * * *